US009729965B2

(12) United States Patent
Sun et al.

(10) Patent No.: US 9,729,965 B2
(45) Date of Patent: Aug. 8, 2017

(54) PERCENTILE FILTERING OF NOISE REDUCTION GAINS

(75) Inventors: Xuejing Sun, Beijing (CN); Glenn N. Dickins, Como (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 94 days.

(21) Appl. No.: 14/413,692

(22) PCT Filed: Aug. 1, 2012

(86) PCT No.: PCT/US2012/049229

§ 371 (c)(1),
(2), (4) Date: Jan. 8, 2015

(87) PCT Pub. No.: WO2014/021890

PCT Pub. Date: Feb. 6, 2014

(65) Prior Publication Data

US 2015/0215700 A1 Jul. 30, 2015

(51) Int. Cl.

| | |
|---|---|
| ***G10L 21/0208*** | (2013.01) |
| ***H04R 3/00*** | (2006.01) |
| ***G10L 21/0232*** | (2013.01) |
| *G10L 25/78* | (2013.01) |
| *G10L 25/18* | (2013.01) |

(52) U.S. Cl.

CPC ..... *H04R 3/002* (2013.01); *G10L 21/0232* (2013.01); *G10L 25/18* (2013.01); *G10L 25/78* (2013.01)

(58) Field of Classification Search

CPC ..... H04R 1/1083; H04R 2225/43; H04R 3/04
USPC ..... 381/94.1, 94.2, 94.3
See application file for complete search history.

(56) References Cited

U.S. PATENT DOCUMENTS

| | | | |
|---|---|---|---|
| 5,442,462 | A | 8/1995 | Guissin |
| 5,563,962 | A | 10/1996 | Peters |
| 6,961,423 | B2 | 11/2005 | Pessoa |

(Continued)

FOREIGN PATENT DOCUMENTS

| | | |
|---|---|---|
| EP | 2463856 | 6/2012 |
| WO | 2008/142587 | 11/2008 |
| WO | 2011/004299 | 1/2011 |

OTHER PUBLICATIONS

Harju, P.T. et al "Delayless Signal Smoothing Using a Median and Predictive Filter Hybrid" IEEE 3rd International Conference on Signal Processing, vol. 1, Oct. 14-18, 1996, pp. 87-90.
Weiss, Ben "Fast Median and Bilateral Filtering" Proc. of ACM Siggraph ACM Transactions on Graphics, vol. 25, Issue 3, Jul. 2006, pp. 519-526.

(Continued)

*Primary Examiner* — George Monikang
(74) *Attorney, Agent, or Firm* — Charles L. Hamilton; Fountainhead Law Group, P.C.

(57) ABSTRACT

A method of post-processing banded gains for applying to an audio signal, an apparatus to post-processed banded gains, and a tangible computer-readable storage medium comprising instructions that when executed carry out the method. The banded gains are determined by input processing one or more input audio signals. The method includes post-processing the banded gains to generate post-processed gains, generating a particular post-processed gain for a particular frequency band including percentile filtering using gain values from one or more previous frames of the one or more input audio signals and from gain values for frequency bands adjacent to the particular frequency band.

20 Claims, 12 Drawing Sheets

(56) References Cited

U.S. PATENT DOCUMENTS

| | | | | |
|---|---|---|---|---|
| 7,643,945 | B2 | 1/2010 | Baklanov | |
| 8,437,482 | B2 | 5/2013 | Seefeldt | |
| 2005/0240401 | A1 | 10/2005 | Ebenezer | |
| 2005/0278150 | A1* | 12/2005 | Mohamed | G06K 9/36 702/190 |
| 2009/0262969 | A1* | 10/2009 | Short | H04R 3/005 381/370 |
| 2009/0274310 | A1* | 11/2009 | Taenzer | G10L 21/0208 381/57 |
| 2010/0027812 | A1* | 2/2010 | Moon | H03G 3/32 381/107 |
| 2010/0111400 | A1 | 5/2010 | Ramirez | |
| 2010/0128841 | A1 | 5/2010 | Imas | |
| 2014/0126745 | A1 | 5/2014 | Dickins | |

OTHER PUBLICATIONS

Sawicki, Janusz "Frequency Response of 2-D Median Filters" IEEE The Fourth International Workshop on Multidimensional Systems, Jul. 10-13, 2005, pp. 7-11.

Linhard, K. et al. "Noise Reduction with Spectral Subtraction and Median Filtering for Suppression of Musical Tones" Robust Speech Recognition for Unknown Communication Channels, Pont-a-Mousson, France, Apr. 17-18, 1997, pp. 159-162.

Esch, T. et al "Efficient Musical Noise Suppression for Speech Enhancement Systems" IEEE International Conference on Acoustics,, Speech and Signal Processing, Piscataway, NJ, USA, Apr. 19, 2009, pp. 4409-4412.

Ching-Ta Lu, et al "Reduction of Residual Noise Using Directional Median Filter" IEEE International Conference on Computer Science and Automation Engineering, Jun. 10, 2011, pp. 475-479.

* cited by examiner

800

PERCENTILE FILTERING OF NOISE REDUCTION GAINS

FIELD OF THE INVENTION

The present disclosure relates generally to signal processing, in particular of audio signals.

BACKGROUND

An acoustic noise reduction system typically includes a noise estimator and a gain calculation module to determine a set of noise reduction gains that are determined, for example, on a set of frequency bands, and applied to the (noisy) input audio signal after transformation to the frequency domain and banding to the set of frequency bands to attenuate noise components. The acoustic noise reduction system may include one microphone, or a plurality of microphone inputs and downmixing, e.g., beamforming to generate one input audio signal. The acoustic noise reduction system may further include echo reduction, and may further include out-of-location signal reduction.

Musical noise is known to exist, and might occur because of short term mistakes over time made on the gain in some of the bands. Such gains-in-error can be considered statistical outliers, that is, values of the gain that across a group of bands statistically lie outside an expected range, so appear "isolated."

Such statistical outliers might occur in other types of processing in which an input audio signal is transformed and banded. Such other types of processing include perceptual domain-based leveling, perceptual domain-based dynamic range control, and perceptual domain-based dynamic equalization that takes into account the variation in the perception of audio depending on the reproduction level of the audio signal. See, for example, International Application PCT/US2004/016964, published as WO 2004111994. It is possible that the gains determined for each band for leveling and/or dynamic equalization include statistical outliers, e.g., isolated values, and such outliers might cause artifacts such as musical noise.

Median filtering the gains, e.g., noise reduction gains, or leveling and/or dynamic equalization gains across frequency bands can reduce musical noise artifacts.

Gain values may vary significantly across frequencies, and in such a situation, running a relatively wide median filter along frequency bands has the risk of disrupting the continuity of temporal envelope, which is the inherent property for many signals and is crucial to perception as well. Whilst offering greater immunity to the outliers, a longer median filter can reduce the spectral selectivity of the processing, and potentially introduce greater discontinuities or jumps in the gain values across frequency and time.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

DESCRIPTION OF EXAMPLE EMBODIMENTS

Overview

Figure 1:
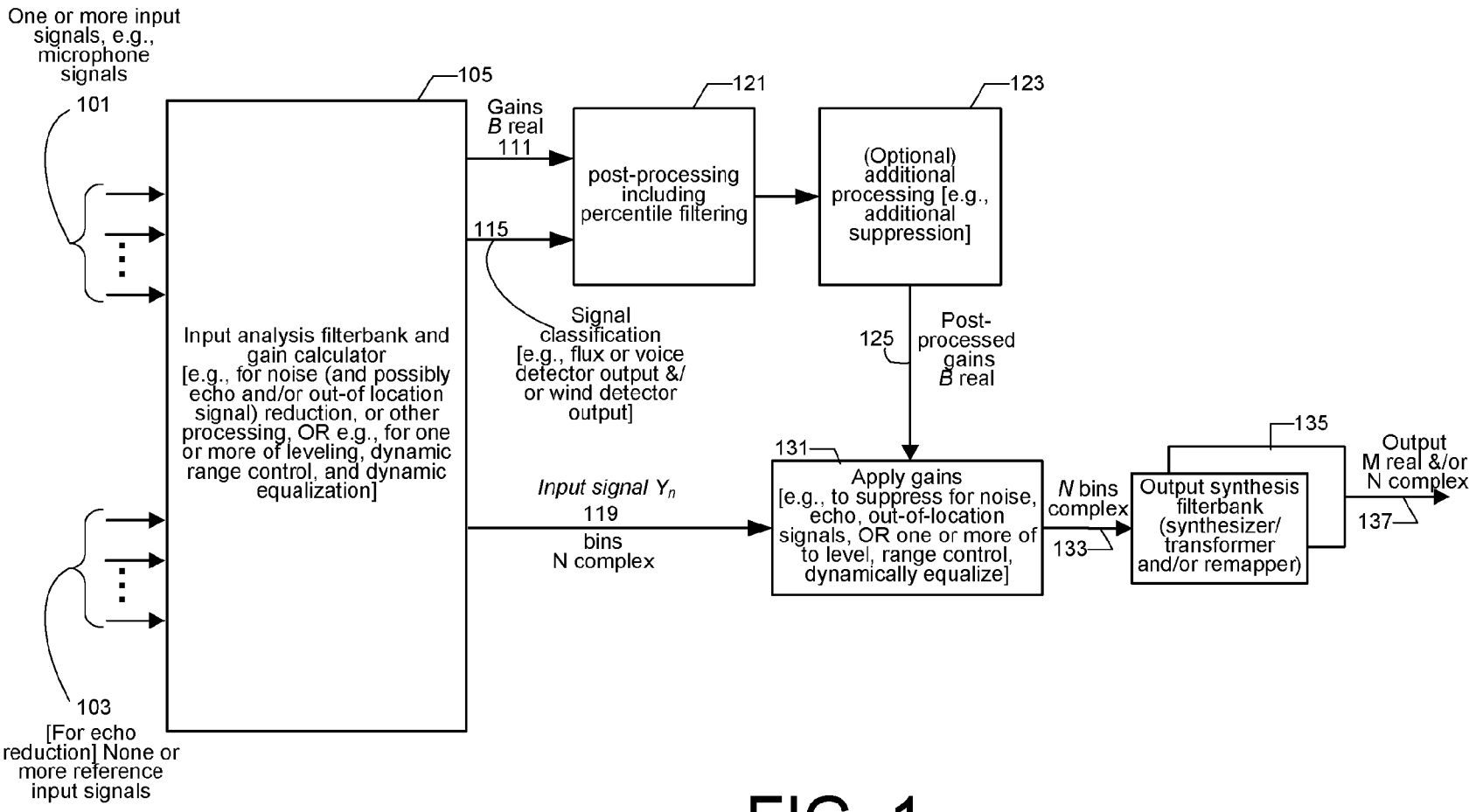
FIG. 1 shows one example of processing of a set of one or more input audio signals, e.g., microphone signals 101 from differently located microphones, including an embodiment of the present invention.

Embodiments of the present invention include a method, an apparatus, and logic encoded in one or more computer-readable tangible medium to carry out the method.

One embodiment includes a method of post-processing banded gains for applying to an audio signal, the banded gains determined by input processing one or more input audio signals. The method comprises post-processing the banded gains to generate post-processed gains, generating a particular post-processed gain for a particular frequency band including percentile filtering using gain values from one or more previous frames of the one or more input audio signals and from gain values for frequency bands adjacent to the particular frequency band.

One embodiment includes an apparatus to post-process banded gains for applying to an audio signal, the banded gains determined by input processing one or more input audio signals. The apparatus comprises a post-processor accepting the banded gains to generate post-processed gains, generating a particular post-processed gain for a particular frequency band including percentile filtering using gain values from one or more previous frames of the one or more input audio signals and from gain values for frequency bands adjacent to the particular frequency band.

In some embodiments, the post-processing includes after the percentile filtering at least one of frequency-band-to-frequency-band smoothing and smoothing across time.

In some embodiments, one or both the width and depth of the percentile filtering depends on signal classification of the one or more input audio signals. In some embodiments, the classification includes whether the input audio signals are likely or not to be voice.

In some embodiments, one or both the width and depth of the percentile filtering depends on the spectral flux of the one or more input audio signals.

In some embodiments, one or both the width and depth of the percentile filtering for the particular frequency band depends on the particular frequency band being determined by the percentile filtering.

In some embodiments, the frequency bands are on a perceptual or logarithmic scale.

In some embodiments, the percentile filtering is of a percentile value, and, for example, the percentile value is the median. In some embodiments, the percentile filtering is of a percentile value, and the percentile value depends on one or more of a classification of the one or more input audio signals and the spectral flux of the one or more input audio signals.

In some embodiments, the percentile filtering is weighted percentile filtering.

In some embodiments, the banded gains determined from one or more input audio signals are for reducing noise. In some embodiments, the banded gains are determined from more than one input audio signal and are for reducing noise and out-of-location signals. In some embodiments, the banded gains are determined from one or more input audio signals and one or more reference signals, and are for reducing noise and echoes.

One embodiment includes a tangible computer-readable storage medium comprising instructions that when executed by one or more processors of a processing system cause processing hardware to carry out a method of post-processing banded gains for applying to an audio signal as described herein.

One embodiment includes program logic that when executed by at least one processor causes carrying out a method as described herein.

Particular embodiments may provide all, some, or none of these aspects, features, or advantages. Particular embodiments may provide one or more other aspects, features, or advantages, one or more of which may be readily apparent to a person skilled in the art from the figures, descriptions, and claims herein.

Some Example Embodiments

One aspect of the invention includes percentile filtering of gains for gain smoothing, e.g., for noise reduction or for other input processing. A percentile filter replaces a particular gain value with a predefined percentile of a predefined number of values, e.g., the predefined percentile of the particular gain value and a predefined set of neighboring gain values. One example of a percentile filter is a median filter for which the predefined percentile is the 50th percentile. Note that the predefined percentile may be a parameter, and may be data dependent. Therefore, in some examples described herein, there may be a first predefined percentile for one type of data, e.g., data likely to be noise, and a different second percentile value for another type of data, e.g., data likely to be voice. A percentile filter is sometimes called a rank order filter, in which case, rather than a predefined percentile, the predefined rank order is used. For example, for an integer number of 9 values, the third rank order filter would output the third largest value of the nine values, while a fifth rank order filter would output the fifth largest value, which is the median, i.e., the 50th percentile.

FIG. 1 shows one example of processing of a set of one or more input audio signals, e.g., microphone signals 101 from differently located microphones, including an embodiment of the present invention. The processing is by time frames of a number, e.g., M samples. In a simple embodiment, there is only one input, e.g., one microphone, and in another embodiment, there is a plurality, denoted P of inputs, e.g., microphone signals 101. An input processor 105 accepts sampled input audio signal(s) 101 and forms a banded instantaneous frequency domain amplitude metric 119 of the input audio signal(s) 101 for a plurality B of frequency bands. In some embodiments in which there is more than one input audio signal, the metric 119 is mixed-down from the input audio signal. The amplitude metric represents the spectral content. In many of the embodiments described herein, the spectral content is in terms of the power spectrum. However, the invention is not limited to processing power spectral values. Rather, any spectral amplitude dependent metric can be used. For example, if the amplitude spectrum is used directly, such spectral content is sometimes referred to as spectral envelope. Thus, the phrase "power (or other amplitude metric) spectrum" is sometimes used in the description.

Note that in some embodiments, the post-processing of gains relates to gains that use additional signal properties in the bands, such as phase or group delay and/or correlations across a sub-band between multiple input channels.

In one noise reduction embodiment, the input processor 105 determines a set of banded gains 111 to apply to the instantaneous amplitude metric 119. In one embodiment the input processing further includes determining a signal classification of the input audio signal(s), e.g., an indication of whether the input audio signal(s) is/are likely to be voice or not as determined by a voice activity detector (VAD), and/or an indication of whether the input audio signal(s) is/are likely to be wind or not as determined by a wind activity detector (WAD), and/or an indication that the signal energy is rapidly changing as indicated, e.g., by the spectral flux exceeding a threshold.

A feature of embodiments of the present invention includes post-processing the gains to improve the quality of the output. In one embodiment the post-processing includes percentile filtering of the gains determined by the input processing. A percentile filter considers a set of gains and outputs the gain that is a predefined percentile of the set of gains. One example of percentile filtering is a median filter. Another example is a percentile filter that operates on a set of P values, P an integer, and selects the p'th value, where $1<p<P$. A set of B gains is determined every frame, so that there is a time sequence of sets of B gains over B frequency bands. While in one embodiment, the percentile filter extends across frequency, in some embodiments of the present invention, the percentile filter extends across both time and frequency, and determines, for a particular frequency band for a currently processed time frame, a predefined percentile value, e.g., the median, or another percentile of: 1) the gains at each of a set of set of frequency bands at the current time, including the particular frequency band and a predefined number of frequency bands neighboring the particular frequency; and 2) the gains of at least the particular frequency at one or more previous time frames.

Figure 2:
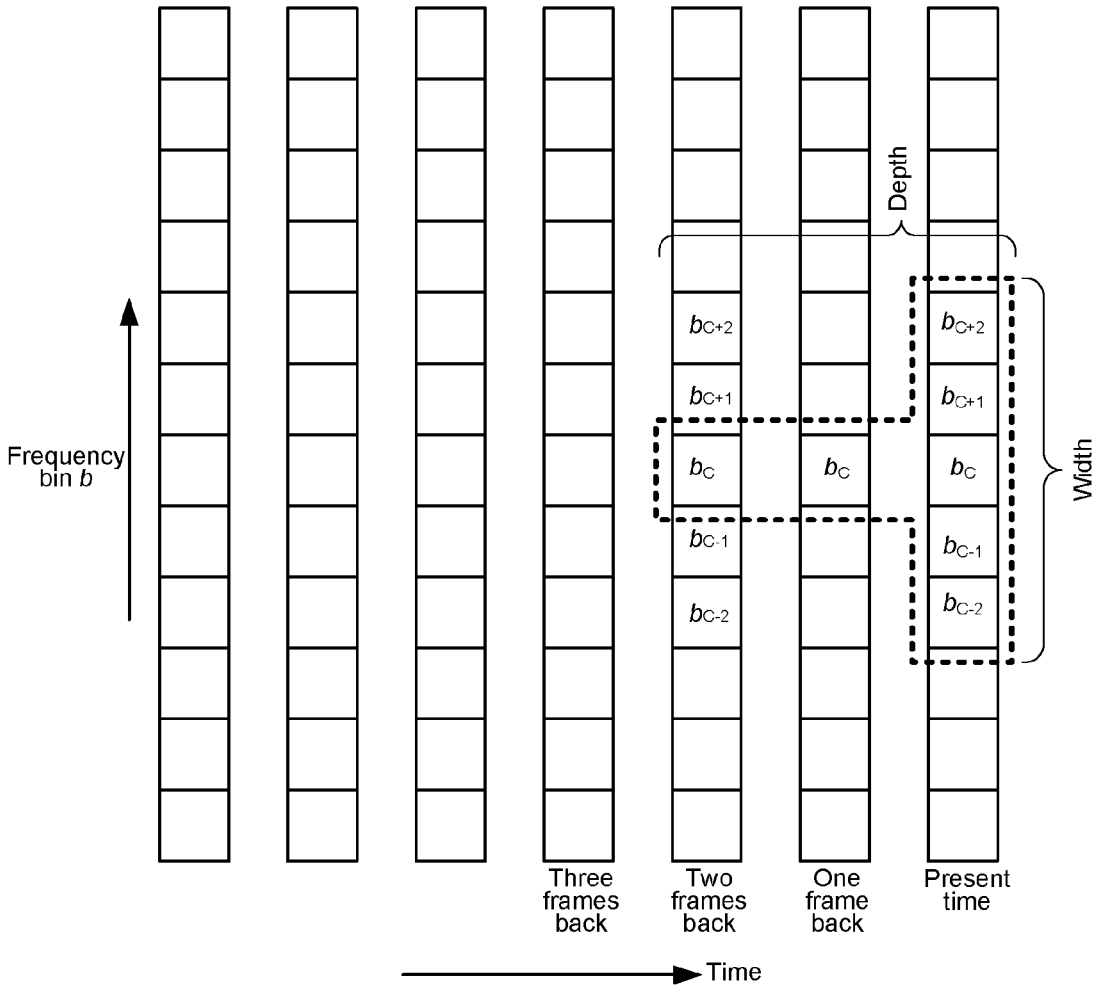
FIG. 2 shows diagrammatically sets of banded gains and the time-frequency coverage of one embodiment of a percentile filter of embodiments of the present invention.

FIG. 2 shows diagrammatically sets of banded gains, one set for each of the present time, one frame back, two frames back, three frames back, etc., and further shows the coverage of an example percentile filter that includes five gain values centered around a frequency band $b_C$ in the present frame and two gain values at the two previous time frames for the same frequency band $b_C$. By filter width we mean the width of the filter in the frequency band domain, and by filter depth, we mean the depth of the filter in the time domain. A memoryless percentile filter only carries out percentile filtering on the same time frame, so has a filter depth of 1. The T-shaped percentile filter shown in FIG. 2 has a width of 5 and a depth of 3.

More details of different embodiments of the percentile filter and filtering are provided herein below.

Returning to FIG. 1, the post-processing produces a set of post-processed gains 125 that are applied to the instantaneous power (or other amplitude metric) 119 to produce output, e.g., as a plurality of processed frequency bins 133. An output synthesis filterbank 135 (or for subsequent coding, a transformer/remapper) converts these frequency bins to desired output 137.

Input processing element 105 includes an input analysis filterbank, and a gain calculator. The input analysis filterbank, for the case of one input audio signal 101, includes a transformer to transform the samples of a frame into frequency bins, and a banding element to form frequency bands, most of which include a plurality of frequency bins. The input analysis filterbank, for the case of a plurality of input audio signals 101, includes a transformer to transform the samples of a frame of each of the input audio signals into frequency bins, a downmixer, e.g., a beamformer to downmix the plurality into a single signal, and a banding element to form frequency bands, most of which include a plurality of frequency bins.

In one embodiment, the transformer implements short time Fourier transform (STFT). For computational efficiency, the transformer uses a discrete finite length Fourier transform (DFT) implemented by a fast Fourier transform (FFT). Other embodiments use different transforms.

In one embodiment, the B bands are at frequencies whose spacing is monotonically non-decreasing. A reasonable number, e.g., 90% of the frequency bands include contribution from more than one frequency bin, and in particular embodiments, each frequency band includes contribution from two or more frequency bins. In some embodiments, the bands are monotonically increasing in a logarithmic-like manner. In some embodiments, the bands are on a psycho-acoustic scale, that is, the frequency bands are spaced with a scaling related to psycho-acoustic critical spacing, such banding called "perceptually-spaced banding" herein. In particular embodiments, the band spacing is around 1 ERB or 0.5 Bark, or equivalent bands with frequency separation at around 10% of the centre frequency. A reasonable range of frequency spacing is from 5-20% or approximately 0.5 . . . 2 ERB.

In some embodiments in which the input processing includes noise reduction, the input processing also includes echo reduction. One example of input processing that includes echo reduction is described in U.S. Provisional Application No. 61/441,611 filed 10 Feb. 2011 to inventors Dickins et al. titled "COMBINED SUPPRESSION OF NOISE, ECHO, AND OUT-OF-LOCATION SIGNALS," the contents of which are hereby incorporated by reference. For those embodiments in which the input processing includes echo reduction, one or more reference signals also are included and used to obtain an estimate of some property of the echo, e.g., of the power (or other amplitude metric) spectrum of the echo. The resulting banded gains achieve simultaneous echo reduction and noise reduction.

In some embodiments that include noise reduction and echo reduction, the post-processed gains are accepted by an element 123 that modifies the gains to include additional echo suppression. The result is a set of post-processed gains 125 that are used to process the input audio signal in the frequency domain, e.g., as frequency bins, after downmixing if there are more than one input audio signals, e.g., from differently located microphones.

Gain application module 131 accepts the post-processed banded gains 125 and applies such gains. In one embodiment, the band gains are interpolated and applied to the frequency bin data of the input audio signal (if one) or the downmixed input audio signal (if there is more than one input audio signal), denoted $Y_n$, n=0, 1, . . . , N−1, where N is the number of frequency bins. $Y_n$, n=0, 1, . . . , N−1 are the frequency bins of a frame of input audio signal samples $Y_m$, m=1, M. The processed data 133 may then be converted back to the sample domain by an output synthesis filterbank 135 to produce a frame of M signal samples 137. In some embodiments, in addition or instead, the signal 133 is subject to transformation or remapping, e.g., to a form ready for coding according to some coding method.

An example embodiment of a system similar to that of U.S. 61/441,611 that includes input processing to reduce noise (and possibly echo and out of location signals) is described in more detail below.

The invention, of course, is not limited to the input processing and gain calculation described in U.S. 61/441,611, or even to noise reduction.

While in one embodiment the input processing is to reduce noise (and possibly echo and out of location signals), in other embodiments, the input processing may be, additionally or primarily, to carry out one or more of perceptual domain-based leveling, perceptual domain-based dynamic range control, and perceptual domain-based dynamic equalization that take into account the variation in the perception of audio depending on the reproduction level of the audio signal, as described, for example, in commonly owned WO 2004111994. The banded gains calculated per WO 2004111994 are post-processed, including percentile filtering, to determine post-processed gains 125 to apply to the (transformed) input.

Example Percentile Filters

Figure 3A:
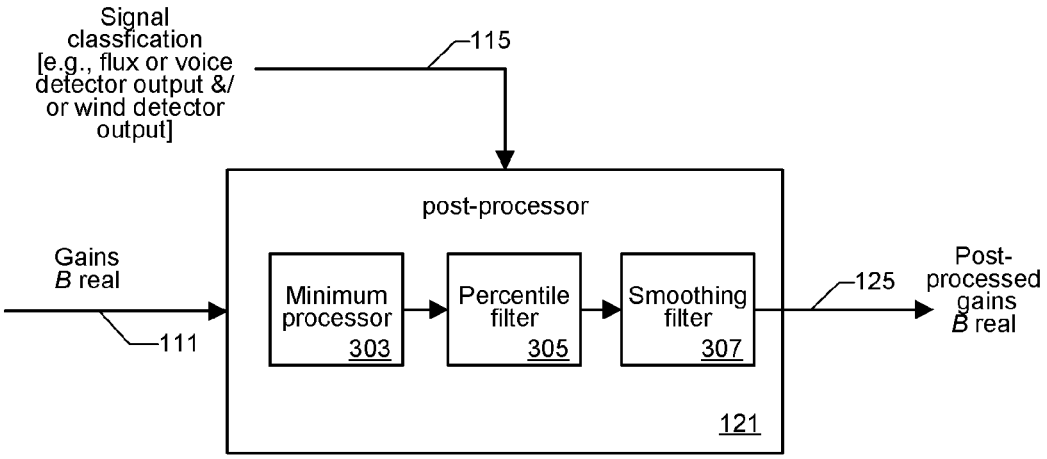
FIG. 3A shows a simplified block diagram of a post-processor that includes a percentile filter according to an embodiment of the present invention.
Figure 3B:
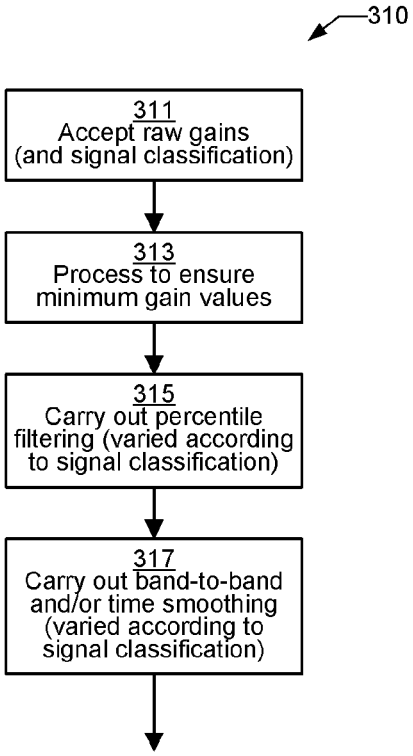
FIG. 3B shows a simplified flowchart of a method of post-processing that includes percentile filtering according to an embodiment of the present invention.

FIG. 3A shows a simplified block diagram of a post-processor 121 that includes a percentile filter 305 according to an embodiment of the present invention. The post-processor 121 accepts gains 111 and in embodiments in which the post-processing changes according to signal classification, one or more signal classification indicators 115, e.g., the outputs of one or more of a VAD, a WAD, or a high rate of energy change, e.g., high spectral flux detector. While not included in all embodiments, some embodiments of the post-processor include a minimum gain processor 303 to ensure that the gains do not fall below a predefined, possibly frequency-dependent value. Again while not included in all embodiments, some embodiments of the post-processor include a smoothing filter 307 that processes the gains after percentile filtering to smooth frequency-band-to-frequency-band variations, and/or to smooth time variations. FIG. 3B shows a simplified flowchart of a method of post-processing 310 that includes in 311 accepting raw gains, and in embodiments in which the post-processing changes according to signal classification, one or more signal classification indicators 115. The post-processing includes percentile filtering 315 according to embodiments of the present invention. The inventors have found that percentile filtering is a powerful nonlinear smoothing technique, which works well for eliminating undesired outliers when compared with only using a smoothing method. Some embodiments include in step 313 ensuring that the gains do not fall below a predefined minimum, which may be frequency band dependent. Some embodiments further include, in step 317, band-to-band and/or time smoothing, e.g., linear smoothing using, e.g., a weighted moving average.

Thus, in some embodiment of the present invention, a percentile filter 315 of banded gain values is characterized by: 1) the number of banded gains to include to determine the percentile value, 2) the time and frequency band positions of the banded gains that are included; 3) how to count each gain value in determining the percentile according to the gain value's position in time and frequency; and 4) the edge conditions, i.e., the conditions used to extend the banded gains to allow calculation of the percentile at the edges of time and frequency band; 5) how the characterization of the percentile filter is affected by the signal classification, e.g., one or more of the presence of voice, the presence of wind, and rapidly changing energy as indicated by high spectral flux; 6) how one or more percentile filter characteristics vary over frequency band; 6) in the case of percentile filtering in the time dimension, whether the time delayed gain values are the raw gains (direct) or are the gains after one or more of the post-processing steps, e.g., after percentile filtering (recursive).

Some embodiments include a mechanism to control one or more of the percentile filtering characteristics over frequency and/or time based on signal classification. For example, in one embodiment that includes voice activity detection, one or more of the percentile filtering characteristics vary in accordance to whether the input is ascertained by a VAD to be voice or not. In one embodiment that includes wind activity detection, one or more of the percentile filtering characteristics vary in accordance to whether the input is ascertained by a WAD to be wind or not, and in yet another embodiment, one or more of the percentile filtering characteristics vary in accordance to how fast the energy is changing in the signal, e.g., as indicated by a measure of spectral flux.

Examples of different edge conditions include (a) extrapolating of interior values for the edges; (b) using the minimum gain value to extend the banded gains at the edges, (c) using a zero gain value to extend the banded gains at the edges (d) duplicating the central filter position value to extend the banded gains at the edges, and (e) using a maximum gain value to extend the banded gains at the edges.

Additional Post-Processing

While not included in all embodiments, in some embodiments the post-processor 121 includes a minimum gain processor 303 that carries out step 313 to ensure the gains do not fall below a predefined minimum gain value. In some embodiments, the minimum gain processor ensures minimum values in a frequency-band dependent manner. In some embodiments, the manner of prevention minimum is dependent on the activity classification 115, e.g., whether voice or not.

In one embodiment, denoting the calculated gains from the input processing by $\text{Gain}'_{b,S}$, some alternatives for the gains denoted $\text{Gain}'_{b,RAW}$ after minimum processor are $$\text{Gain}'_{b,RAW} = \text{Gain}'_{b,MIN} + (1 - \text{Gain}'_{b,MIN}) \cdot \text{Gain}'_{b,S}$$

$$\text{Gain}'_{b,RAW} = \text{Gain}'_{b,MIN} + \text{Gain}'_{b,S}$$

$$\text{Gain}'_{b,RAW} = \begin{cases} \text{Gain}'_{b,MIN} & \text{Gain}'_{b,S} < \text{Gain}'_{b,MIN} \\ \text{Gain}'_{b,S} & \text{otherwise} \end{cases}$$

As one example, in some embodiments of post-processor 121 and step 310, the range of the maximum suppression depth or minimum gain may range from −80 dB to −5 dB and be frequency dependent. In one embodiment the suppression depth was around −20 dB at low frequencies below 200 Hz, varying to be around −10 dB at 1 kHz and relaxing to be only −6 dB at the upper voice frequencies around 4 kHz. Furthermore, in one embodiment, if a VAD determines the signal to be voice, $\text{Gain}'_{b,MIN}$ is increased, e.g., in a frequency-band dependent way (or in another embodiment, by the same amount for each band b). In one embodiment, the amount of increase in the minimum is larger in the mid-frequency bands, e.g., bands between 500 Hz to 2 kHz.

Furthermore, while not included in all embodiments, in some embodiments the post-processor 121 includes a smoothing filter 307, e.g., a linear smoothing filter that carries out one or both of frequency band-to-band smoothing and time smoothing. In some embodiments, such smoothing is varied according to signal classification 115.

One embodiment of smoothing 317 uses a weighted moving average with a fixed kernel. One example uses a binomial approximation of a Gaussian weighting kernel for the weighted moving average. As one example, a 5-point binomial smoother has a kernel 1/16[1 4 6 4 1]. In practice, of course, the factor 1/16 may be left out, with scaling carried out in one point or another as needed. As another example, a 3-point binomial smoother has a kernel 1/4[1 2 1]. Many other weighted moving average filters are known, and any such filter can suitably be modified to be used for the band-to-band smoothing of the gain.

In one embodiment, the band-to-band median filtering is controlled by the signal classification. In one embodiment, a VAD, e.g., a spatially-selective VAD is included, and if the VAD determines there is voice, the degree of smoothing is increased when noise is detected. In one example embodiment, 5-point band-to-band weighted average smoothing is carried out in the case the VAD indicates voice is detected, else, when the VAD determines there is no voice, no smoothing is carried out.

In some embodiments, time smoothing of the gains also is included. In some embodiments, the gain of each of the B bands is smoothed by a first order smoothing filter:

$$\text{Gain}_{b,Smoothed} = \alpha_b \text{Gain}_b + (1-\alpha_b)\text{Gain}_{b,Smoothed_{Prev}}$$

where $\text{Gain}_b$ is the current time-frame gain, $\text{Gain}_{b,Smoothed}$ is the time-smoothed gain, and $\text{Gain}_{b,Smoothed_{Prev}}$ is $\text{Gain}_{b,Smoothed}$ from the previous M-sample frame. $\alpha_b$ is a time constant which may be frequency band dependent and is typically in the range of 20 to 500 ms. In one embodiment a value of 50 ms was used. In one embodiment, the amount of time smoothing is controlled by the signal classification of the current frame. In a particular embodiment that includes first order time smoothing of the gains, the signal classification of the current frame is used to control the values of first order time constants used to filter the gains over time in each band. In the case a VAD is included, one embodiment stops time smoothing in the case voice is detected.

The inventors found it is important that aggressive smoothing be discontinued at the onset of voice. Thus it is preferable that the parameters of post-processing are controlled by the immediate signal classifier (VAD, WAD) value that has low latency and is able to achieve a rapid transition of the post-processing from noise into voice (or other desired signal) mode. The speed with which more aggressive post-processing is reinstated after detection of voice, i.e., at the trail out, has been found to be less important, as it affects intelligibility of voice to a lesser extent.

The Time Frequency Characteristics

When the desired gain values vary significantly across frequencies, e.g., due to desired selectivity or activity of the noise suppression or gain calculation algorithm, or for another reason, the inventors discovered that running the percentile filter along frequency axis has the risk of disrupting the continuity of temporal envelope, which is the inherent property for many signals and is crucial to perception as well. Whilst offering greater immunity to the outliers, a longer percentile filter will reduce the spectral selectivity of the processing, and potentially introduce greater discontinuities or jumps in the gain values across frequency and time. To minimize the discontinuity of time envelope in each frequency band, some embodiments of the present invention use a 2-D percentile filter, e.g., median filter which incorporates both time and frequency information. Such a filter can be characterized by a time-frequency window around a particular frequency band ("target" band) to produce a filtered value for the target frequency band. In particular, some embodiments of the present invention use a T-shape filter where previous time values of the just target band are included for each target band. FIG. 2 shows one such embodiment of a 7-point T-shape filter where two previous values of the target band are included. In one such set of embodiments, the percentile value is the median value, such that the percentile filter is a median filter.

In some embodiments, the time delayed gain values are the raw gains (direct), so that the percentile filter is non-recursive in time, while in other embodiments that use time and frequency percentile filtering, the time delayed gain values are those after one or more of the post-processing steps, e.g., after percentile filtering, so that the percentile filter is recursive in time.

An Example of Voice Activity Control

In one embodiment, the band-to-band percentile filtering is controlled by the signal classification. In one embodiment, a VAD is included, and if the VAD determines it is likely that there is no voice, a 7 point T-shaped median filter with 5-point band-to-band and 3-point time percentile filtering is carried out, with edge processing including extending minimum gain values or a zero value at the edges to compute the percentile value. If the VAD determines it is likely that voice is present, in a first version, a 5-point T-shaped time-frequency percentile filtering is carried out with three frequency bands in the current time frame, and using two previous time frames, and in a second embodiment, a three point memoryless frequency-band only percentile filter, with the edge values extrapolated at the edges to calculate the percentile, is used. In one such set of embodiments, the percentile value is the median value, such that the percentile filter is a median filter.

An Example of Wind Activity Control

One feature of the present invention is that the percentile filtering depends on the classification of the signal, and one such classification, in some embodiments, is whether there is wind or not. In some embodiments, a WAD is included, and if the WAD determines there is no wind, and a VAD indicates there is no voice, fewer gain values are included in the percentile filter. When wind is present, the set of gains may show greater variation in time, in particular at the lower frequency bands. When WAD and a VAD is included, if the WAD determines there is likely not to be wind and the VAD determines voice is likely, the percentile filtering should be shorter and no time filtering, e.g., by using 3-point memoryless band-to-band percentile filter, with extrapolating the edge values applied at the edges. If the WAD indicated wind is unlikely, and the VAD indicates voice is also unlikely, more percentile filtering in both frequency band and time can be used, e.g., a 7 point T-shaped median filter with 5-point band-to-band and 3-point time percentile filtering is carried out, with edge processing including extending minimum gain values or a zero value at the edges to compute the percentile value. If the WAD indicated wind is likely, and the VAD indicates voice is unlikely, even more percentile filtering in both frequency band and time can be used, e.g., a 9 point T-shaped median filter with 7-point band-to-band and 3-point time percentile filtering can be carried out, with edge processing including extending minimum gain values or a zero value at the edges to compute the percentile value. In one embodiment, the percentile filtering when the WAD indicates wind is present and there is likely to be voice is frequency dependent, with 7-point band-to-band filtering for lower frequency bands, e.g., bands including less than 1 kHz, and 7-point band-to-band percentile filtering for the other (higher) frequency bands, with 3-point time percentile filtering for all frequency bands. Such greater percentile filtering at the lower frequency bands may prevent the prevalence of sporadic high gains. With wind and voice present, one would be less aggressive with the percentile filtering. In one such set of embodiments, the percentile value is the median value, such that the percentile filter is a median filter. Note that with wind present, the VAD may be less reliable.

In general, in some embodiments it is found useful for the median filter at lower frequencies (<1 kHz) to extend to cover a larger spectral band range (100-500 Hz) and longer time duration (50-200 ms) to remove short low frequency wind bursts. In the presence of wind activity and low probability of voice, this wider filter may extend to higher frequencies. Since this filtering may have an impact on voice, if there is wind activity and a reasonable probability of voice a shorter filter would be used.

Spectral Flux Control of Time Frequency Characteristics

The spectral flux of a signal can be used as a criterion to determine how quickly the power (or other amplitude metric) spectrum of a signal is changing. In some embodiments of the present invention, the spectral flux is used to control the characteristics of the percentile filter. If the signal spectrum is changing too fast, the temporal dimension of the percentile filter can be reduced, e.g., if the spectral flux is above a pre-defined threshold, a five point memoryless frequency-band only percentile filter extrapolated at the edges is used. In yet a different embodiment, normally, a 5-point band-to-band and 3 point time T-shaped time-frequency percentile filter is used, while if the spectral flux is above a pre-defined threshold, a 3 by 3 5-point T-shaped time-frequency percentile filtering is used.

Control of the Percentile Value

The above described percentile filtering operates around short kernel filters, e.g., 3, 5 or 7 points. In addition to the edge constraints, and length, one characteristic that can be varied is which percentile value is computed. For example, for a 5 point percentile filter, the second largest value, or the second highest value could be selected instead of the $50^{th}$ percentile, i.e., median value. The percentile value may be controlled by the signal classification. For example, in one embodiment that includes voice activity detection, five-point frequency-band-to-frequency-band memoryless percentile filtering can be used, with the second smallest value selected when the VAD determines it is likely voice is not present, and the second largest value selected in when the VAD determines it is likely voice is present. The use of other than the strict 50th percentile also allows for the use of an even number of data points in each percentile filter kernel. For example in one embodiment, a 6-tap T-shaped percentile filter is used having 5 taps in the frequency band domain and 2 taps in the time domain. In the case a VAD is included, the percentile filter is configured to select the third highest value (60th percentile) in increasing sorted order when it is likely that voice is present, and to select the third smallest value (40th percentile) when it is likely that voice is not present.

Weighting the Percentile Calculation

In some embodiments, rather than the direct percentile of a set of gain values around a target frequency band at the current time, the different frequency band (and possibly time) locations used in the percentile filtering are weighted differently. For example, in one embodiment, the central gain tap in the percentile filter population is duplicated. In such a case, considering the T-shaped percentile filter of FIG. 2, the central band denoted $b_C$ at the present time is counted twice, so that in total there are eight values of which the percentile value is used as the output of the percentile filter. In other embodiments, each location in the filter kernel is counted an integer number of times, and the percentile value of the total number of values included is calculated. In yet other embodiments, non-integer weights are used. Integer weights, however, have the advantage a low computational complexity as no multiplications are required to determine the weighted percentile gain value.

In some embodiments, the weighting used in the percentile filtering is made dependent on a classification of the signal. In one embodiment in which voice activity detection is included, for example, the percentile filtering is made dependent on whether it is deemed that the input is voice or not. In one example embodiment, if the current frame is classified as voice, more weight can be put on the center band of current frame over adjacent bands, and if the current frame is classified as unvoiced, the center band and its adjacent bands can be assigned weights evenly. In a particular embodiment, the weighting of the central tap in the median filter is doubled when it is likely that voice is present compared to the weighting used when a voice activity detector determines that not likely that voice is present.

Percentile Filter with Frequency Band Dependent Characteristics

In some embodiments, one or more of the characteristics of the percentile filter are made dependent on the frequency band. For example, the (time) depth the percentile filter and/or the (frequency band) width of the percentile filter is dependent on the frequency band. It is known, for example, that the second formant (F2) in human speech often varies faster than other formants. One embodiment varies the percentile filter such that the depth (in time) and width (in frequency bands) of the percentile filter is less around F2. In one embodiment in which voice activity detection (a VAD) is used, this reducing the amount of percentile filtering around F2 is only in the case that the VAD indicates the input audio signal is likely to be voice.

Note that in the embodiments described above, the banding is on a perceptual or logarithmic scale with the suggested filter lengths in the embodiments presented appropriate for a filter band spacing of around 1 ERB or 0.5 Bark, or equivalently, bands with frequency separation at around 10% of the centre frequency. It would be apparent that the method is also applicable to other banding structures, including linear band spacing; however the values of the filter lengths would scale accordingly. With a linear band structure, it would be more relevant to have the length of the percentile, e.g., median filter increasing with increasing frequency, as this is implicit in the above embodiments that suggest a single length median filter on a logarithmically spaced filterbank.

It should be noted also that the depth of 3 time units (frames) suggested for the T-shaped percentile median filter in the above embodiments is related to the sampling interval of the filterbank. For the above embodiments, a sampling interval of 16 ms was used, giving the extent of median filtering suggested a length of around 48 to 64 ms. The longer length reflects the spread in time due to the filterbank itself.

Considering the two points above, the following recommendation is provided for any median or percentile filtering.

In a noise situation where the probability of voice is deemed to be low, a median filtering over the frequency domain of around ±20% of the band centre frequency is suggested (with a range of ±10% to ±30% considered reasonable), and the extent over the time domain being around 48 ms (with a range of 32 to 64 ms being reasonable, or even longer provided reliable and low latency VAD, e.g., a separate reliable and low latency VAD is available). The percentile filter should select gains that are at or below the median with a range of 20 to 50% considered reasonable when the VAD indicates voice is unlikely to be present.

In a voiced situation where the probability of voice is deemed to be high, a median filter over the frequency domain of around ±10% of the band center frequency is suggested (with a range of 5 to 20% considered reasonable) and the extent over the time domain only using the present time (0 ms with a range of 0 to 48 ms of data being used being reasonable). The percentile filter should select gains that are at or above the median with a range of 50 to 80% considered reasonable when the VAD indicates noise is unlikely to be present.

An Example Acoustic Noise Reduction System

An acoustic noise reduction system typically includes a noise estimator and a gain calculation module to determine a set of noise reduction gains that are determined, for example, on a set of frequency bands, and applied to the (noisy) input audio signal after transformation to the frequency domain and banding to the set of frequency bands to attenuate noise components. The acoustic noise reduction system may include one microphone, or a plurality of inputs from differently located microphones and downmixing, e.g., beamforming to generate one input audio signal. The acoustic noise reduction system may further include echo reduction, and may further include out-of-location signal reduction.

Figure 4:
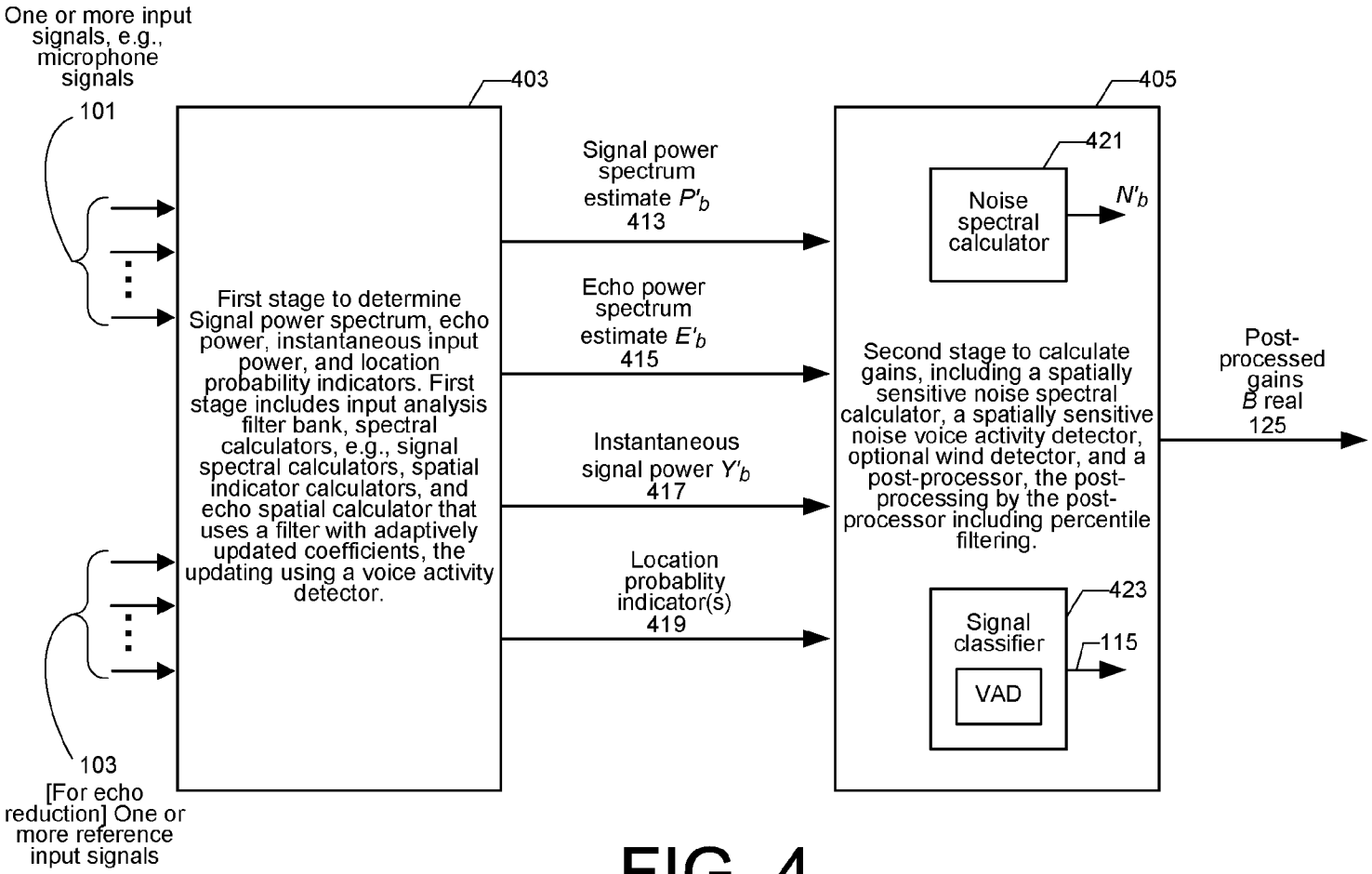
FIG. 4 shows one example of an apparatus embodiment configured to determine a set of post-processed gains for suppression of noise, and in some versions, simultaneous echo suppression, and in some versions, simultaneous suppression of out-of-location signals.

FIG. 4 shows one example of an apparatus configured to determine a set of post-processed gains for suppression of noise, and in some versions, simultaneous echo suppression, and in some versions, simultaneous suppression of out-of-location signals. Such a system is described, e.g., in U.S. 61/441,611. The inputs include a set of one or more input audio signals 101, e.g., signals from differently located microphones, each in sets of M samples per frame. When spatial information is included, there are two or more input audio signals, e.g., signals from spatially separated microphones. When echo suppression is included, one or more reference signals 103 are also accepted, e.g., in frames of M samples. These may be, for example, one or more signals from one or more loudspeakers, or, in another embodiment, the signal(s) that are used to drive the loudspeaker(s). A first input processing stage 403 determines a banded signal power (or other amplitude metric) spectrum 413 denoted $P'_b$, and a banded measure of the instantaneous power 417 denoted $Y'_b$. When more than one input audio signal is included, each of the spectrum 413 and instantaneous banded measure 417 is of the inputs after being mixed down by a downmixer, e.g., a beamformer. When echo suppression is included, the first input processing stage 403 also determines a banded power spectrum estimate of the echo 415, denoted $E'_b$, the determining being from a previously calculated power spectrum estimates of the echo using a filter with a set of adaptively determined filter coefficients. In those versions that include out-of-location signal suppression, the first input processing stage 403 also determines spatial features 419 in the form of banded location probability indicators 419 that are usable to spatially separate a signal into the components originating from the desired location and those not from the desired direction.

The quantities from the first stage 403 are used in a second stage 405 that determines gains, and that post-processes the gains, including the percentile filtering of embodiments of the present invention, to determine the banded post-processed gains 125. Embodiments of the second stage 405 include a noise power (or other amplitude metric) spectrum calculator 421 to determine a measure of the noise power (or other amplitude metric) spectrum, denoted $E'_b$, and a signal classifier 423 to determine a signal classification 115, e.g., one or more of a voice activity detector (VAD), a wind activity detector, and a power flux calculator. FIG. 4 shows the signal classifier 423 including a VAD.

Figure 5:
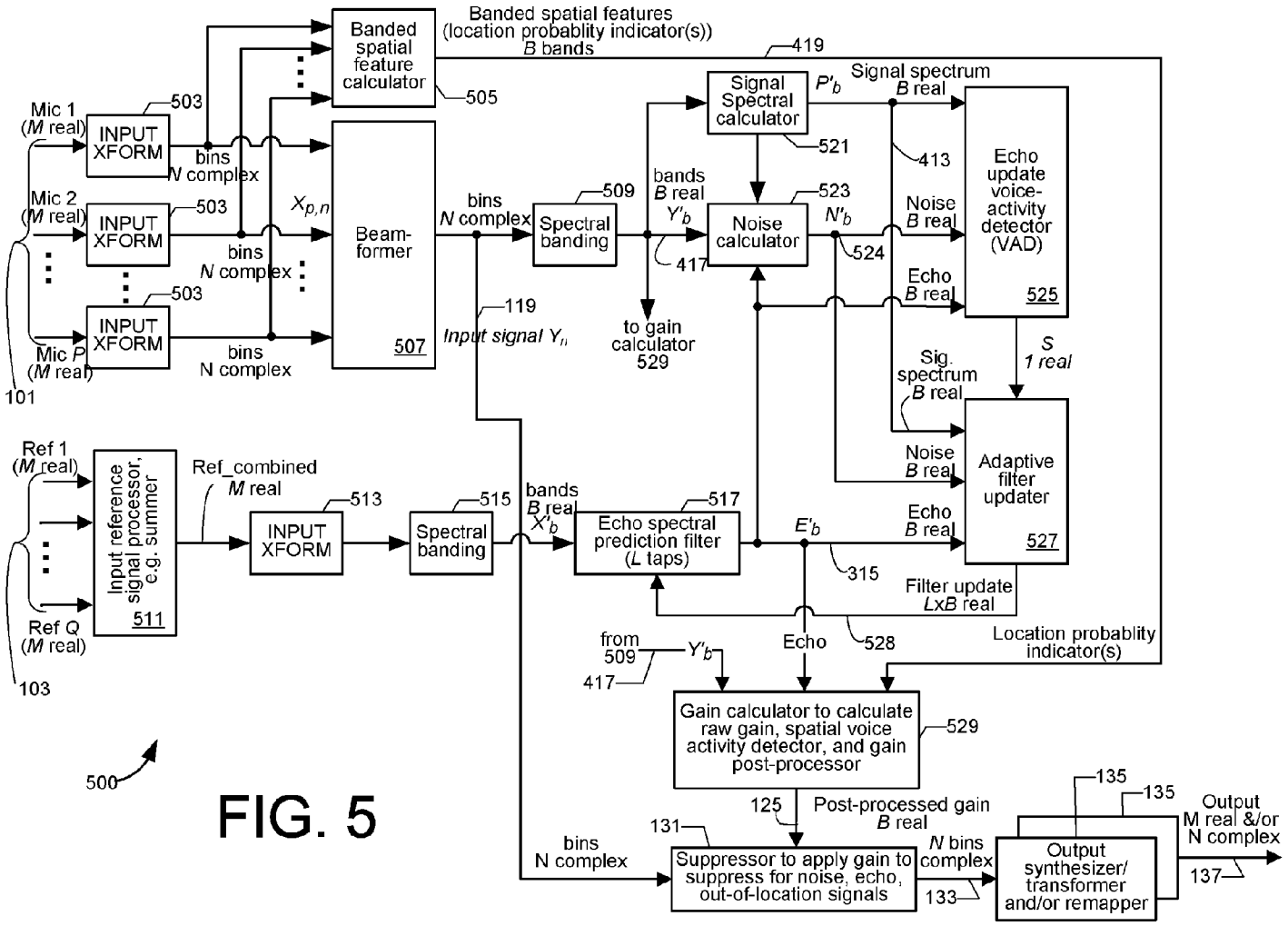
FIG. 5 shows one example of an apparatus embodiment in more detail.

FIG. 5 shows one embodiment 500 of the elements of FIG. 4 in more detail, and includes, for the example embodiment of noise, echo, and out-of-location noise suppression, the suppressor 131 that applied the post-processed gains 125 and the output synthesizer (or transformer or remapper) 135 to generate the output signal 137.

Comparing FIGS. 4 and 5, the first stage processor 403 of FIG. 4 includes elements 503, 505, 507, 509, 511, 513, 515, 517, 521, 523, 525, and 527 of FIG. 5. In more detail, the input(s) frame(s) 101 are transformed by inputs transformer(s) 503 to determine transformed input signal bins, the number of frequency bins denoted by N. In the case of more than one input audio signal, these frequency domain signals are beamformed by a beamformer 507 to form input frequency bin data denoted $Y_n$, n=1, . . . , N, and the input frequency bin data $Y_n$ is banded by spectral banding element 509 into B spectral bands, in one embodiment, perceptually spaced spectral bands to produce the instantaneous banded measure of the power $Y'_b$, b=1, . . . , B. In a version that includes out-of-location suppression and more than one input audio signal, the frequency domain signals from the input transformers 503 are accepted by a banded spatial feature calculator to determine banded location probability indictors, each between 0 and 1. In a version that includes echo suppression, if there is more than one reference signal, say Q reference signals, the signals are combines by combiner 511, in one embodiment a summer, to produce a combined reference input. An input transformer 513 and spectral bander 515 convert the reference into banded reference spectral content denoted $X'_b$, b=1, . . . , B for the B bands. An L-tap linear prediction filter 517 predicts the banded echo spectral content $E'_b$, b=1, . . . , B, using L times B filter update coefficients 528. A signal spectral calculator 521 calculates a measure of the (mixed-down) power (or other amplitude metric) spectrum $P'_b$, b=1, . . . , B. In some embodiments, $Y'_b$ is used as a good-enough approximation to $P'_b$.

The L B filter coefficients for filter 517 are determined by an adaptive filter updater 527 that uses the current banded echo spectral content $E'_b$, the measure of the (mixed-down) power (or other amplitude metric) spectrum $P'_b$, a banded noise power (or other amplitude metric) spectrum 524 denoted $N'_b$, b=1, . . . , B, and determined by a noise calculator 523 from the instantaneous power $Y'_b$ and a measure from the signal spectral calculator 521. The updating is triggered by a voice activity signal denoted S as determined by a voice activity detector (VAD) 525 using $P'_b$ (or $Y'_b$), $N'_b$, and $E'_b$. When S exceeds a threshold, the signal is assumed to be voice. The VAD derived in the echo update voice-activity detector 525 and filter updater 527 serves the specific purpose of controlling the adaptation of the echo prediction. A VAD or detector with this purpose is often referred to as a double talk detector. In one embodiment, the echo filter coefficient updating of updater 527 is gated, with updating occurring when the expected echo is significant compared to the expected noise and current input power, as determined by the VAD 525 and indicated by a low value of local signal activity S.

Details of how the elements the first stage 403 per FIGS. 4 and 5 operate in some embodiments are as follows. In one embodiment, the input transformers 503, 511 determine the short time Fourier transform (STFT). In another embodiment, the following transform and inverse pair is used for the forward transform in elements 503 and 511, and in output synthesis element 135.

$$X_{2n} = \frac{1}{\sqrt{N}} \sum_{n'=0}^{N-1} e^{\frac{-i\pi n'}{2N}} (u_{n'} x_{n'} - i u_{N+n'} x_{N+n'}) e^{\frac{-i2\pi nn'}{N}} \quad n = 0 \ldots N/2-1$$

$$X_{2n+1} = \frac{1}{\sqrt{N}} \sum_{n'=0}^{N-1} e^{\frac{-i\pi n'}{2N}} (u_{n'} x_{n'} + i u_{N+n'} x_{N+n'}) e^{\frac{-i2\pi nn'}{N}} \quad n = 0 \ldots N/2-1$$

$$y_n = v_n \mathrm{real}\left[\frac{1}{\sqrt{N}} e^{\frac{i\pi n}{4N}} \left(\sum_{n'=0}^{N/2-1} X_{n'} e^{\frac{i4\pi nn'}{N}} + \sum_{n'=N/2}^{N-1} \overline{X_{N-n'-1}} e^{\frac{i4\pi nn'}{N}}\right)\right] n = 0 \ldots N/2-1$$

where $y_{N+n} =$ $$-v_{N+n} \mathrm{imag}\left[\frac{1}{\sqrt{N}} e^{\frac{i\pi n}{4N}} \left(\sum_{n'=0}^{N/2-1} X_{n'} e^{\frac{i4\pi nn'}{N}} + \sum_{n'=N/2}^{N-1} \overline{X_{N-n'-1}} e^{\frac{i4\pi nn'}{N}}\right)\right] n = 0 \ldots N-1$$

$i^2=-1$, $u_n$ and $v_n$ are appropriate window functions, $x_n$ represents the last 2N input samples with $x_{N-1}$ representing the most recent sample, $X_n$ represents the N complex-valued frequency bins in increasing frequency order. The inverse transform or synthesis is represented in the last two equation lines. $y_n$ represents the 2N output samples that result from the individual inverse transform prior to overlapping, adding and discarding as appropriate for the designed windows. It should be noted, that this transform has an efficient implementation as a block multiply and FFT. Note that the use of $x_n$ and $X_n$ in the above expressions of transform is for convenience. In other parts of this disclosure, $X_n$, n=0, . . . , N−1, denote the frequency bins of the signal representative of the reference signals, and $Y_n$, n=0, . . . , N−1, denote the frequency bins of the mixed-down input audio signals.

In one embodiment, the window functions $u_n$ and $v_n$ for the above transform in one embodiment is the sinusoidal window family, of which one suggested embodiment is $$u_n = v_n = \sin\left(\frac{n+\frac{1}{2}}{2N}\pi\right) \quad n = 0 \ldots 2N-1.$$

It should be apparent to one skilled in the art that the analysis and synthesis windows, also known as prototype filters, can be of length greater or smaller than the examples given herein.

While the invention works with any mixed-down signal, in some embodiments, the downmixer is a beamformer 507 designed to achieve some spatial selectivity towards the desired position. In one embodiment, the beamformer 507 is a linear time invariant process, i.e., a passive beamformer defined in general by a set of complex-valued frequency-dependent gains for each input channel. For the example of a two-microphone array, with the desired sound source located broad side to the array, i.e., at the perpendicular bisector, one embodiment uses for beamformer 507 a passive beamformer 107 that determines the simple sum of the two input channels. In some versions, beamformer 507 weights the sets of inputs (as frequency bins) by a set of complex valued weights. In one embodiment, the beamforming weights of beamformer 107 are determined according to maximum-ratio combining (MRC). In another embodiment, the beamformer 507 uses weights determined using zero-forcing. Such methods are well known in the art.

The banding of spectral banding elements 509 and 514 can be described by $$Y'_b = W_b \sum_{n=0}^{N-1} w_{b,n} |Y_n|^2$$

where $Y_b$ is the banded instantaneous power of the mixed-down, e.g., beamformed signal, $W_b$ is the normalization gain and $w_{b,n}$ are elements from a banding matrix.

The signal spectral calculator 521 in one embodiment is described by a smoothing process $$P'_b = \alpha_{P,b}(Y'_b + Y'_{min}) + (1-\alpha_{P,b})P_{b_{PREV}},$$

where $P'_{b_{PREV}}$ is a previously, e.g., the most recently determined signal power (or other frequency domain amplitude metric) estimate, $\alpha_{P,b}$ is a time signal estimate time constant, and $Y'_{min}$ is an offset. A suitable range for the signal estimate time constant $\alpha_{P,b}$ was found to be between 20 to 200 ms. In one embodiment, the offset $Y'_{min}$ is added to avoid a zero level power spectrum (or other amplitude metric spectrum) estimate. $Y'_{min}$ can be measured, or can be selected based on a priori knowledge. $Y'_{min}$, for example, can be related to the threshold of hearing or the device noise threshold.

In one embodiment, the adaptive filter 517 includes determining the instantaneous echo power spectrum (or other amplitude metric spectrum), denoted $T'_b$ for band b by using an L tap adaptive filter described by $$T'_b = \sum_{l=0}^{L-1} F_{b,l} X'_{b,l},$$

where the present frame is $X'_b = X'_{b,0}$, where $X'_{b,0}$, . . . $X'_{b,1}$, . . . $X'_{b,L-1}$ are the L most recent frames of the (combined) banded reference signal $X'_b$, including the present frame $X'_b = X'_{b,0}$ and where the L filter coefficients for a given band b are denoted by $F_{b,0}$, . . . , $F_{b,1}$, . . . $F_{b,L-1}$, respectively.

One embodiment includes time smoothing of the instantaneous echo from echo prediction filter 517 to determine the echo spectral estimate $E'_b$. In one embodiment, a first order time smoothing filter is used as follows $$E'_b = T'_b \text{ for } T'_b \geq E'_{b_{Pr\,ev}}, \text{ and}$$

$$E'_b = \alpha_{E,b} T'_b + (1-\alpha_{E,b}) E'_{b_{Pr\,ev}} \text{ for } T'_b < E'_{b_{Pr\,ev}}$$

where $E'_{b_{Pr\,ev}}$ is the previously determined echo spectral estimate, e.g., in the most recently, or other previously determined estimate, and $\alpha_{E,b}$ is a first order smoothing time constant.

In one embodiment, the noise power spectrum calculator 523 uses a minimum follower with exponential growth:

$$N'_b = \min(P'_b, (1+\alpha_{N,b}) N'_{b_{Pr\,ev}}) \text{ when } E'_b \text{ is less than } N'_{b_{Pr\,ev}}$$

$$N'_b = N'_{b_{Pr\,ev}} \text{ otherwise,}$$

where $\alpha_{Ni}$, is a parameter that specifies the rate over time at which the minimum follower can increase to track any increase in the noise. In one embodiment, the criterion $E'_b$ is less than $N'_{b_{Pr\,ev}}$ is if $E'_b < N'_{bPr\,ev}/2$, i.e., that the (smoothed) echo spectral estimate $E'_b$ is less than the previous value of $N'_b$ less 3 dB, in which case the noise estimate follows the growth or current power. Otherwise, $N'_b = N'_{b_{Pr\,ev}}$, i.e., $N'_b$ is held at the previous value of $N'_b$. The parameter $\alpha_{N,b}$ is best expressed in terms of the rate over time at which minimum follower will track. That rate can be expressed in dB/sec, which then provides a mechanism for determining the value of $\alpha_{N,b}$. The range is 1 to 30 dB/sec. In one embodiment, a value of 20 dB/sec is used.

In other embodiments, different approaches for noise estimation may be used. Examples of such different approached include but are not limited to alternate methods of determining a minimum over a window of signal observation, e.g., a window of 1 and 10 seconds. In addition or alternate to the minimum, such different approaches might also determine the mean and variance of the signal during times that it is classified as likely to be noise or that voice is unlikely.

In one embodiment, the one or more leak rate parameters of the minimum follower are controlled by the probability of voice being present as determined by voice activity detecting (VAD). In one embodiment, VAD element 525 determines an overall signal activity level denoted S as $$S = \sum_{b=1}^{B} \frac{\max(0, Y'_b - \beta_N N'_b - \beta_E E'_b)}{Y'_b + Y'_{sens}}$$

where $\beta_N$, $\beta_B > 1$ are margins for noise end echo, respectively and $Y'_{sens}$ is a settable sensitivity offset. These parameters may in general vary across the bands. In one embodiment, the values of $\beta_N$, $\beta_E$ are between 1 and 4. In a particular embodiment, $\beta_N$, $\beta_E$ are each 2. $Y'_{sens}$ is set to be around expected microphone and system noise level, obtained by experiments on typical components. Alternatively, one can use the threshold of hearing to determine a value for $Y_{sens}$.

In one embodiment, the echo filter coefficient updating of updater 527 is gated, as follows. If the local signal activity level is low, e.g., below a pre-defined threshold $S_{thresh}$, i.e., if $S<S_{thresh}$, then the adaptive filter coefficients are updated as:

$$F_{b,l} = F_{b,l} + \mu \frac{(\max(0, Y'_b - \gamma_N N'_b) - T'_b)X'_{b,l}}{\sum_{l''=0}^{L-1} (X'^2_{b,l''} + X'^2_{sens})} \text{ if } S < S_{thresh},$$

where $\gamma_N$ is a tuning parameter tuned to ensure stability between the noise and echo estimate. A typical value for $\gamma_N$ is 1.4 (+3 dB). A range of values 1 to 4 can be used. $\mu$ is a tuning parameter that affects the rate of convergence and stability of the echo estimate. Values between 0 and 1 might be useful in different embodiments. In one embodiment, $\mu=0.1$ independent of the frame size M. $X'_{sens}$ is set to avoid unstable adaptation for small reference signals. In one embodiment $X'_{sens}$ is related to the threshold of hearing. The choice of value for $S_{thresh}$ depends on the number of bands. $S_{thresh}$ is between 1 and B, and for one embodiment having 24 bands to 8 kHz, a suitable range was found to be between 2 and 8, with a particular embodiment using a value of 4.

Embodiments of the present invention use spatial information in the form of one or more measures determined from one or more spatial features in a band b that are monotonic with the probability that the particular band b has such energy incident from a spatial region of interest. Such quantities are called spatial probability indicators. In one embodiment, the one or more spatial probability indicators are functions of one or more banded weighted covariance matrices of the input audio signals. Given the output of the P input transforms $X_{p,n}$, p=1, . . . , P, with N frequency bins, n=0, . . . , N−1, we construct a set of weighted covariance matrices to correspond by summing the product of the input vector across the P inputs for bin n with its conjugate transpose, and weighting by a banding matrix $W_b$ with elements $w_{b,n}$ $$R'_b = \sum_{n=0}^{N-1} w_{b,n}[\, X_{1,n} \;\; \ldots \;\; X_{P,n}\,]^H [\, X_{1,n} \;\; \ldots \;\; X_{P,n}\,].$$

The $w_{b,n}$ provide an indication of how each bin is weighted for contribution to the bands. In some embodiments, the one or more covariance matrices are smoothed over time. In some embodiments, the banding matrix includes time dependent weighting for a weighted moving average, denoted as $W_{b,l}$ with elements $w_{b,n,l}$ where l represents the time frame, so that, over L time frames, $$R'_b = \sum_{n=0}^{N-1} \sum_{l=0}^{L-1} w_{b,n,l}[\, X_{1,n} \;\; \ldots \;\; X_{P,n}\,]^H [\, X_{1,n} \;\; \ldots \;\; X_{P,n}\,].$$

In the case of two inputs, P=2, define $$R'_b = \begin{bmatrix} R'_{b11} & R'_{b12} \\ R'_{b21} & R'_{b22} \end{bmatrix},$$

so that each band covariance matrix $R'_b$ is a 2×2 Hermetian positive definite matrix with $R'_{b21}=\overline{R'_{b12}}$, where the overbar is used to indicate the complex conjugate.

Denote by the spatial feature "ratio" a quantity that is monotonic with the ratio of the banded magnitudes $$\frac{R'_{b11}}{R'_{b22}}.$$

In one embodiment, a log relationship is used:

$$\text{Ratio}'_b = 10\log_{10} \frac{R'_{b11} + \sigma}{R'_{b22} + \sigma}$$

where $\sigma$ is a small offset added to avoid singularities. $\sigma$ can be thought of as the smallest expected value for $R'_{b11}$. In one embodiment, it is the determined, or estimated (a priori) value of the noise power (or other frequency domain amplitude metric) in band b for the microphone and related electronics. That is, the minimum sensitivity of any preprocessing used.

Denote by the spatial feature phase a quantity monotonic with $\tan^{-1} R'_{b21}$.

$$\text{Phase}'_b = \tan^{-1} R'_{b21}.$$

Denote by the spatial feature "coherence" a quantity that is monotonic with $$\frac{R'_{b21} R'_{b12}}{R'_{b11} R'_{b22}}.$$

In some embodiments, related measures of coherence could be used such as $$\frac{2R'_{b21} R'_{b12}}{R'_{b11} R'_{b11} + R'_{b22} R'_{b22}}$$

or values related to the conditioning, rank or eigenvalue spread of the covariance matrix. In one embodiment, the coherence feature is $$\text{Coherence}'_b = \sqrt{\frac{R'_{b21} R'_{b12} + \sigma^2}{R'_{b11} R'_{b22} + \sigma^2}}.$$

with offset $\sigma$ as defined above.

One feature of some embodiments of the noise, echo and out-of-location signal suppression is that, based on the a priori expected or current estimate of the desired signal features—the target values, e.g., representing spatial location, gathered from statistical data—each spatial feature in each band can be used to create a probability indicator for the feature for the band b.

In one embodiment, the distributions of the expected spatial features for the desired location are modeled as Gaussian distributions that present a robust way of capturing the region of interest for probability indicators derived from each spatial feature and band.

Three spatial probability indicators are related to these three spatial features, and are the ratio probability indicator, denoted $RPI'_b$, the phase probability indicator, denoted $PPI'_b$, and the coherence probability indicator, denoted $CPI'_b$, with $$RPI'_b=f_{R_b}(Ratio'_b-Ratio_{target_b})=f_{R_b}(\Delta Ratio'_b),$$

where $\Delta Ratio'_b=Ratio'_b-Ratio_{target_b}$ and $Ratio_{target_b}$ is determined from either prior estimates or experiments on the equipment used, e.g., headsets, e.g., from data such as shown in FIG. 9A.

The function $f_{R_b}(\Delta Ratio')$ is a smooth function. In one embodiment, the ratio probability indicator function is $$f_{R_b}(\Delta Ratio') = \exp\left[-\frac{\Delta Ratio'_b}{Width_{Ratio,b}}\right]^2,$$

where $Width_{Ratio,b}$ is a width tuning parameter expressed in log units, e.g., dB. The $Width_{Ratio,b}$ is related to but does not need to be determined from actual data. It is set to cover the expected variation of the spatial feature in normal and noisy conditions, but also needs only be as narrow as is required in the context of the overall system to achieve the desired suppression.

For the phase probability indicator, $$PPI'_b=f_{P_b}(Phase'_b-Phase_{target_b})=f_{R_b}(\Delta Phase'_b),$$

where $\Delta Phase'_b=Phase'_b-Phase_{target_b}$ and $Phase_{target_b}$ is determined from either prior estimates or experiments on the equipment used, e.g., headsets, obtained, e.g., from data.

The function $f_{P6di\ b}$ ($\Delta Phase'$) is a smooth function. In one embodiment, $$f_{R_b}(\Delta Phase'_b) = \exp\left[-\frac{\Delta Phase'_b}{Width_{Phase,b}}\right]^2$$

where $Width_{Phase,b}$ is a width tuning parameter expressed in units of phase. In one embodiment, $Width_{Phase,b}$ is related to but does not need to be determined from actual data.

For the Coherence probability indicator, no target is used, and in one embodiment, $$CPI'_b = \left(\frac{R'_{b21}R'_{b12}+\sigma^2}{R'_{b11}R'_{b22}+\sigma^2}\right)^{CFactor_b}$$

where $CFactor_b$ is a tuning parameter that may be a constant value in the range of 0.1 to 10; in one embodiment, a value of 0.25 was found to be effective.

Figure 6:
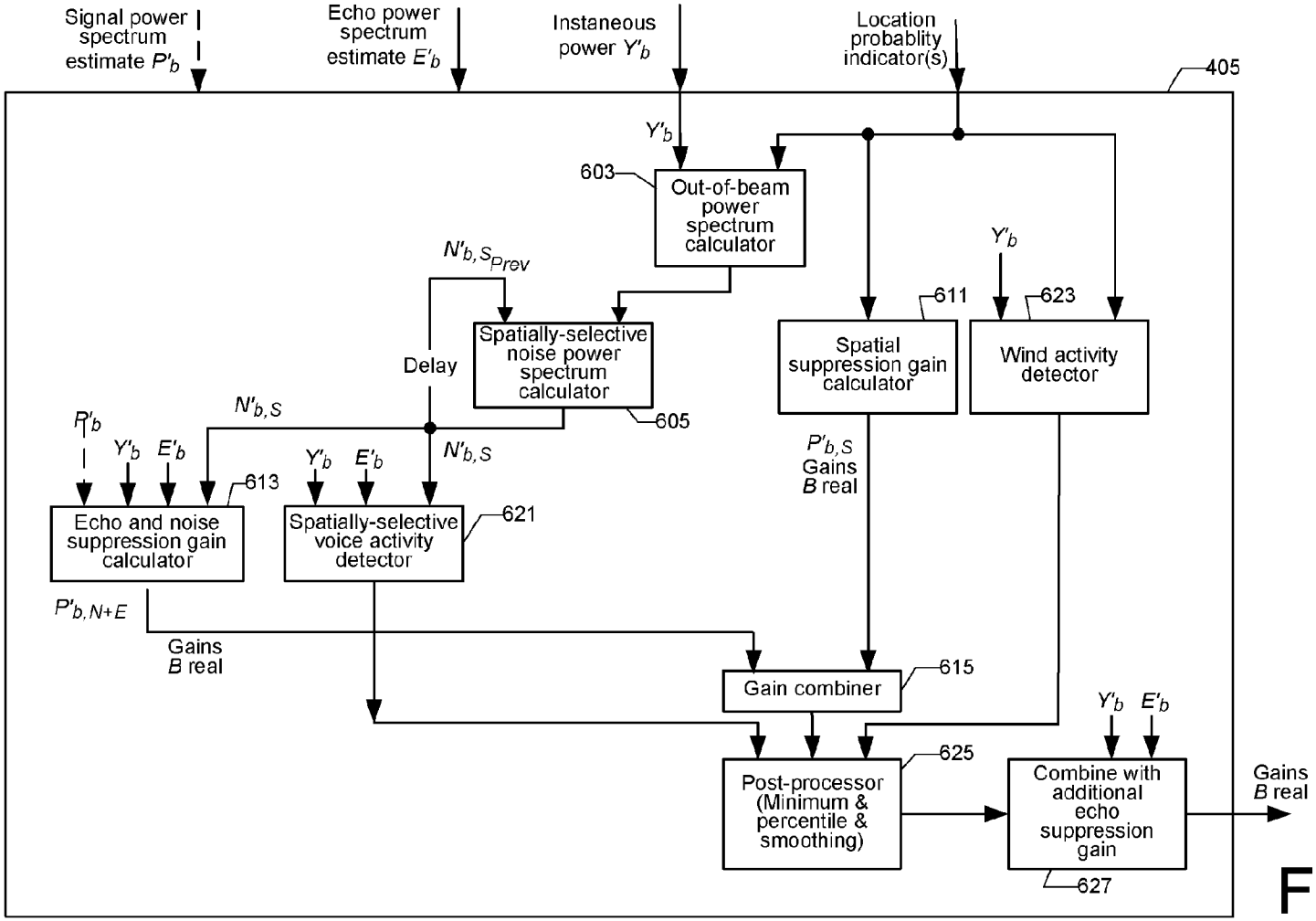
FIG. 6 shows an example embodiment of a gain calculation element that includes a spatially sensitive voice activity detector and a wind activity detector.

FIG. 6 shows one example of the calculation in element 529 of the raw gains, and includes a spatially sensitive voice activity detector (VAD) 621, and a wind activity detector (WAD) 623. Alternate versions of noise reduction may not include the WAD, or the spatially sensitive VAD, and further may not include echo suppression or other reduction. Furthermore, the embodiment shown in FIG. 6 includes additional echo suppression, which may not be included in simpler versions.

In one embodiment, the spatial probability indicators are used to determine what is referred to as the beam gain, a statistical quantity denoted $BeamGain'_b$ that can be used to estimate the in-beam and out-of-beam power from the total power, e.g., using an out-of-beam spectrum calculator 603, and further, can be used to determine the out-of-beam suppression gain by a spatial suppression gain calculator 611. By convention and in the embodiments presented herein, the probability indicators are scaled such that the beam gain has a maximum value of 1.

In one embodiment, the beam gain is $$BeamGain'_b=BeamGain_{min}+(1-BeamGain_{min})\ RPI'_b\cdot PPI'_b\cdot CPI'_b.$$

Some embodiments use $BeamGain_{min}$ of 0.01 to 0.3 (−40 dB to −10 dB). One embodiment uses a $BeamGain_{min}$ of 0.1.

The in-beam and out-of beam powers are:

$$Power'_{b,InBeam}=BeamGain'^2_b Y'_b$$

$$Power'_{b,OutOfBeam}=(1-BeamGain'^2_b)Y'_b.$$

Note that $Power'_{b,InBeam}$ and $Power'_{b,OutOfBeam}$ are statistical measures used for suppression.

In one version of element 603, $$Power'_{b,OutOfBeam}=[0.1+0.9(1-BeamGain_b^2)]Y'_b.$$

One version of gain calculation uses a spatially-selective noise power spectrum calculator 605 that determines an estimate of the noise power (or other metric of the amplitude) spectrum. One embodiment of the invention uses a leaky minimum follower, with a tracking rate determined by at least one leak rate parameter. The leak rate parameter need not be the same as for the non-spatially-selective noise estimation used in the echo coefficient updating. Denote by $N'_{b,S}$ the spatially-selective noise spectrum estimate. In one embodiment, $$N'_{b,S}=\min(Power'_{b,OutOfBeam},(1+\alpha_b)N'_{b,S_{Pr\ ev}}),$$

where $N'_{b,S_{Pr\ ev}}$ is the already determined, i.e., previous value of $N'_{b,S}$. The leak rate parameter $\alpha_b$ is expressed in dB/s such that for a frame time denoted T, $(1+\alpha_b)1/T$ is between 1.2 and 4 if the probability of voice is low, and 1 if the probability of voice is high. A nominal value of $\alpha_b$ is 3 dB/s such that $(1+\alpha_b)1/T=1.4$.

In some embodiments, in order to avoid adding bias to the noise estimate, echo gating is used, i.e., $$N'_{b,S}=\min(Power'_{b,OutOfBeam},(1+\alpha_b)N'_{b,S_{Pr\ ev}}) \text{ if } N'_{b,S_{Pr\ ev}}>2E'_b, \text{ else } N'_{b,S}=N'_{b,S_{Pr\ ev}}.$$

That is, the noise estimate is updated only if the previous noise estimate suggests the noise level is greater, e.g., greater than twice the current echo prediction. Otherwise the echo would bias the noise estimate.

One feature of the noise reducer shown in FIGS. 4, 5 and 6 includes simultaneously suppressing: 1) noise based on a spatially-selective noise estimate, and 2) out-of-beam signals. The gain calculator 529 includes an element 613 to calculates a probability indicator, expressed as a gain for the intermediate signal, e.g., the frequency bins $Y_n$ based on the spatially-selective estimates of the noise power (or other frequency domain amplitude metric) spectrum, and further on the instantaneous banded input power $Y'_b$ in a particular band. For simplicity this probability indicator is referred to as a gain, denoted $Gain_N$. It should be noted however that this gain $Gain_N$ is not directly applied, but rather combined with additional gains, i.e., additional probability indicators in a gain combiner 615 to achieve a single gain to apply to achieve a single suppressive action.

The element 613 is shown with echo suppression, and in some versions does not include echo suppression.

An expression found to be effective in terms of computational complexity and effect is given by $$\mathrm{Gain}'_N = \left(\frac{\max(0,\ Y'_b - \beta'_N N_{b,S})}{Y'_b}\right)^{GainExp}$$

where $Y'_b$ is the instantaneous banded power (or other frequency domain amplitude metric), $N'_{b,S}$ is the banded spatially-selective (out-of-beam) noise estimate, and $\beta'_N$ is a scaling parameter, typically in the range of 1 to 4. In one version, $\beta'_N$=1.5. The parameter GainExp is a control of the aggressiveness or rate of transition of the suppression gain from suppression to transmission. This exponent generally takes a value in the range of 0.25 to 4. In one version, GainExp=2.

Adding Echo Suppression

Some embodiments of input processing for noise reduction include not only noise suppression, but also simultaneous suppression of echo. In some embodiments of gain calculator 529, element 613 includes echo suppression and in gain calculator 529, the probability indicator for suppressing echoes is expressed as a gain denoted $\mathrm{Gain}'_{b,N+E}$. The above noise suppression gain expression, in the case of also including echo suppression, becomes $$\mathrm{Gain}'_{b,N+E} = \left(\frac{\max(0,\ Y'_b - \beta'_N N'_{b,S} - \beta'_E E'_b)}{Y'_b}\right)^{GainExp_b} \qquad \text{("Gain 1")}$$

where $Y'_b$ is again the instantaneous banded power, $N'_{b,S}$, $E'_b$ are the banded spatially-selective noise and banded echo estimates, and $\beta'_N$, $\beta'_E$. are scaling parameters in the range of 1 to 4, to allow for error in the noise and echo estimates and to offset the gain curve accordingly. Again, they are similar in purpose and magnitude to the constants used in the VAD function, though they are not necessarily the same value. In one embodiment suitable tuned values are $\beta'_N$=1.5, $\beta'_E$=1.4, $\mathrm{GainExp}_b$ 2 for all values of b.

Several of the expressions for $\mathrm{Gain}'_{N+E}$ described herein have the instantaneous banded input power (or other frequency domain amplitude metric) $Y'_b$ in both the numerator and denominator. This works well when the banding is properly designed as described herein, with logarithmic-like frequency bands, or perceptually spaced frequency bands. In alternate embodiments of the invention, the denominator uses the estimated banded power spectrum (or other amplitude metric spectrum) $P'_b$, so that the above expression for $\mathrm{Gain}'_{b,N+E}$ changes to:

$$\mathrm{Gain}'_{b,N+E} = \left(\frac{\max(0,\ Y'_b - \beta'_N N'_{b,S} - \beta'_E E'_b)}{P'_b}\right)^{GainExp}. \qquad \text{("Gain } 1_{MOD}\text{")}$$

Additional Independent Control of Echo Suppression

The suppression gain expressions above can be generalized as functions on the domain of the ratio of the instantaneous input power to the expected undesirable signal power, sometimes called "noise" for simplicity. In these gain expressions, the undesirable signal power is the sum of the estimated (location-sensitive) noise power and predicted or estimated echo power. Combining the noise and echo together in this way provides a single probability indicator in the form of a suppressive gain that causes simultaneous attenuation of both undesirable noise and of undesirable echo.

In some cases, e.g., in cases in which the echo can achieve a level substantially higher than the level of the noise, such suppression may not lead to sufficient echo attenuation. For example, in some applications, there may be a need for only mild reduction of the ambient noise, whilst it is generally required that any echo be suppressed below audibility. To achieve such a desired effect, in one embodiment, an additional scaling of the probability indicator or gain is used, such additional scaling based on the ratio of input audio signal to echo power alone.

Denote by $f_A(\bullet)$, $f_B(\bullet)$ a pair of suppression gain functions, each having desired properties for suppression gains, e.g., as described above, including, for example being smooth. As one example, each of $f_A(\bullet)$, $f_B(\bullet)$ has sigmoid function characteristics. In some embodiments, rather than the gain expression being defined as $$f_A\left(\frac{Y'_b}{N'_{b,S} + E'_b}\right),$$

one can instead use a pair of probability indicators, e.g., gains $$f_A\left(\frac{Y'_b}{N'_{b,S}}\right),\ f_B\left(\frac{Y'_b}{E'_b}\right)$$

and determine a combined gain factor from $$f_A\left(\frac{Y'_b}{N'_{b,S}}\right) \text{ and } f_B\left(\frac{Y'_b}{E'_b}\right),$$

which allows for independent control of the aggressiveness and depth for the response to noise and echo signal power. In yet another embodiment, $$f_A\left(\frac{Y'_b}{N'_{b,S} + E'_b}\right)$$

can be applied for both noise and echo suppression, and $$f_B\left(\frac{Y'_b}{E'_b}\right)$$

can be applied for additional echo suppression.

In one embodiment the two functions $$f_A\left(\frac{Y'_b}{N'_{b,S}}\right),\ f_B\left(\frac{Y'_b}{E'_b}\right),$$

or in another embodiment, the two functions $$f_A\left(\frac{Y'_b}{N'_{b,S}+E'_b}\right),\ f_B\left(\frac{Y'_b}{E'_b}\right)$$

are combined as a product to achieve a combined probability indicator, as a suppression gain.

Combining the Suppression Gains for Simultaneous Suppression of Out-of-Location Signals In one embodiment, the suppression probability indicator for in-beam signals, expressed as a beam gain 612, called the spatial suppression gain, and denoted $\text{Gain}_{b,S}$ is determined by a spatial suppression gain calculator 611 in element 529 (FIG. 5) as $$\text{Gain}'_{b,S}=\text{BeamGain}'_b=\text{BeamGain}_{min}+(1-\text{BeamGain}_{min})\text{RPI}'_b\cdot\text{PPI}'_b\cdot\text{CPI}'_b.$$

The spatial suppression gain 612 is combined with other suppression gains in gain combiner 615 to form an overall probability indicator expressed as a suppression gain. The overall probability indicator for simultaneous suppression of noise, echo, and out-of-beam signals, expressed as a gain $\text{Gain}'_{b,RAW}$, is in one embodiment the product of the gains:

$$\text{Gain}'_{b,RAW}=\text{Gain}'_{b,S}\cdot\text{Gain}'_{b,N+E}$$

In an alternate embodiment, additional smoothing is applied. In one example embodiment of the gain element 615:

$$\text{Gain}'_{b,RAW}=0.1+0.9\text{Gain}'_{b,S}\cdot\text{Gain}'_{b,N+E}.$$

where the minimum gain 0.1 and 0.9=(1−0.1) factors can be varied for different embodiments to achieve a different minimum value for the gain, with a suggested range of 0.001 to 0.3 (−60 dB to −10 dB).

The above expression for $\text{Gain}'_{b,RAW}$ suppresses noise and echo equally. As discussed above, it may be desirable to not eliminate noise completely, but to completely eliminate echo. In one such embodiment of gain determination, $$\text{Gain}'_{b,RAW}=0.1+0.9\text{Gain}'_{b,S}\cdot f_A\left(\frac{Y'_b}{N'_{b,S}+E'_b}\right)\cdot f_B\left(\frac{Y'_b}{E'_b}\right),\ \text{where}$$

$$f_A\left(\frac{Y'_b}{N'_{b,S}+E'_b}\right)$$

achieves (relatively) modest suppression of both noise and echo, while $$f_B\left(\frac{Y'_b}{E'_b}\right)$$

suppresses the echo more. In a different embodiment, $f_A(\bullet)$ suppresses only noise, and $f_B(\bullet)$ suppresses the echo.

In yet another embodiment, $$\text{Gain}_{b,RAW}=0.1+0.9\text{Gain}'_{b,S}\cdot\text{Gain}'_{b,N+E},$$

where:

$$\text{Gain}'_{b,E+B}=\left(0.1+0.9f_A\left(\frac{Y'_b}{N'_{b,S}+E'_b}\right)\right)\cdot\left(0.1+0.9f_B\left(\frac{Y'_b}{E'_b}\right)\right).$$

In some embodiments, this noise and echo suppression gain is combined with the spatial feature probability indicator or gain for forming a raw combined gain, and then post-processed by a post-processor 625 and by the post processing step to ensure stability and other desired behavior.

In another embodiment, the gain function $$f_B\left(\frac{Y'_b}{E'_b}\right)$$

specific to the echo suppression is applied as a gain after post-processing by post-processor 625. Some embodiments of gain calculator 529 include a determiner of the additional echo suppression gain and a combiner 627 of the additional echo suppression gain with the post-processed gain to result in the overall B gains to apply. The inventors discovered that such an embodiment can provide a more specific and deeper attenuation of echo, since the echo probability indicator or gain $$f_B\left(\frac{Y'_b}{E'_b}\right)$$

is not subject to the smoothing and continuity imposed by the post-processing.

Figure 7:
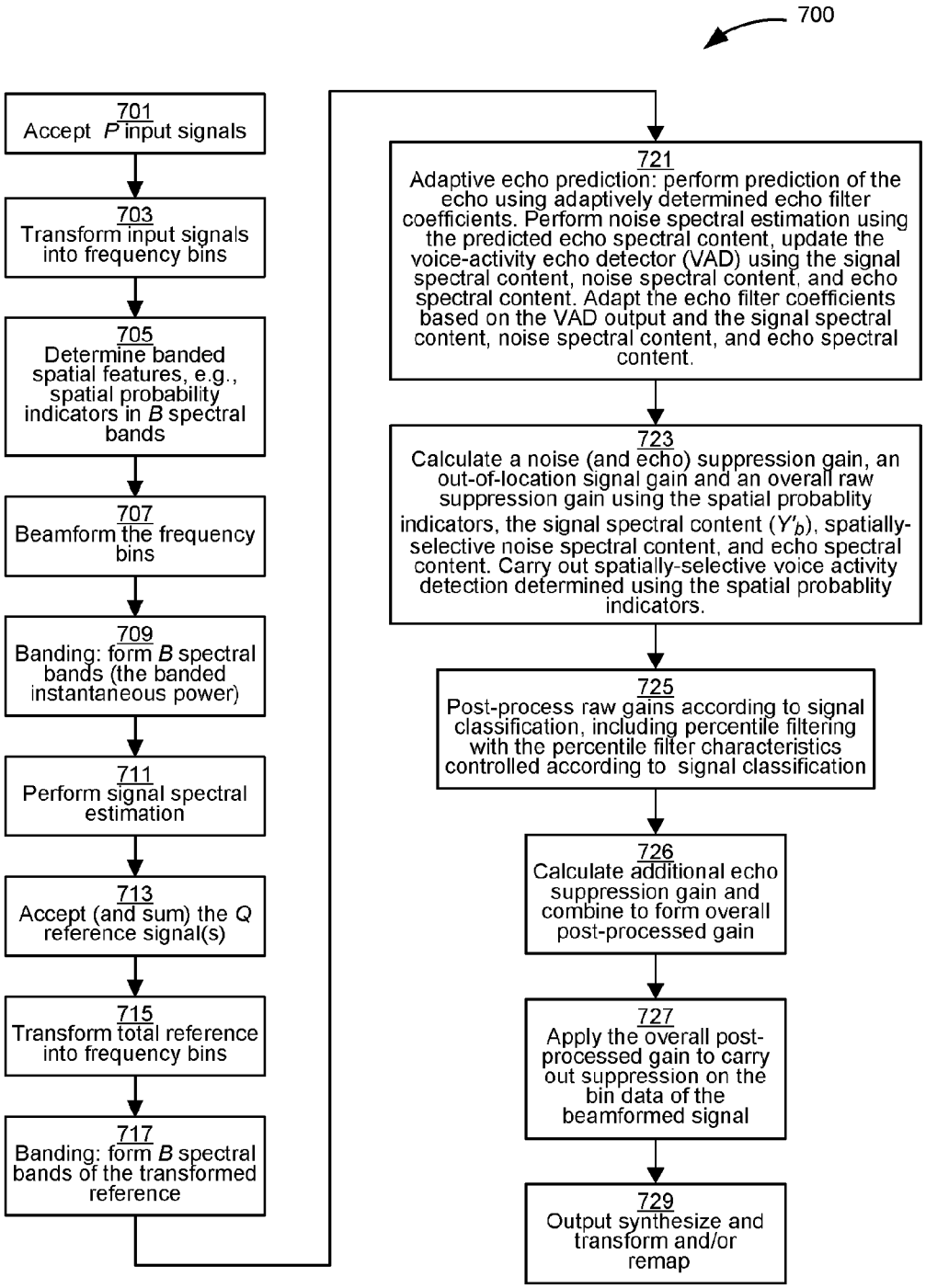
FIG. 7 shows a flowchart of an embodiment of a method of operating a processing apparatus to suppress noise and out-of-location signals and, in some embodiments, echoes.

FIG. 7 shows a flowchart of a method 700 of operating a processing apparatus 100 to suppress noise and out-of-location signals and in some embodiments echo in a number P≥1 of signal inputs 101, e.g., from differently located microphones. In embodiments that include echo suppression, method 700 includes processing a Q≥1 reference inputs 102, e.g., Q inputs to be rendered on Q loudspeakers, or signals obtained from Q loudspeakers.

In one embodiment, method 700 comprises: accepting 701 in the processing apparatus a plurality of sampled input audio signals 101, and forming 703, 707, 709 a mixed-down banded instantaneous frequency domain amplitude metric 417 of the input audio signals 101 for a plurality of frequency bands, the forming including transforming 703 into complex-valued frequency domain values for a set of frequency bins. In one embodiment, the forming includes in 703 transforming the input audio signals to frequency bins, downmixing, e.g., beamforming 707 the frequency data, and in 709 banding. In 711, the method includes calculating the power (or other amplitude metric) spectrum of the signal. In alternate embodiments, the downmixing can be before transforming, so that a single mixed-down signal is transformed. In alternate embodiments, the system may make use of an estimate of the banded echo reference, or a similar representation of the frequency domain spectrum of the echo reference provided by another processing component or source within the realized system.

The method includes determining in 705 banded spatial features, e.g., location probability indicators 419 from the plurality of sampled input audio signals.

In embodiments that include simultaneous echo suppression, the method includes accepting 713 one or more reference signals and forming in 715 and 717 a banded frequency domain amplitude metric representation of the one or more reference signals. The representation in one embodiment is the sum. Again in embodiments that include echo suppression, the method includes predicting in 721 a banded frequency domain amplitude metric representation of the echo 415 using adaptively determined echo filter coefficients. The predicting in one embodiment further includes voice-activity detecting—VAD—using the estimate of the banded spectral amplitude metric of the mixed-down signal 413, the estimate of banded spectral amplitude metric of noise, and the previously predicted echo spectral content 415. The coefficients are updated or not according to the results of voice-activity detecting. Updating uses an estimate of the banded spectral amplitude metric of the noise, previously predicted echo spectral content 415, and an estimate of the banded spectral amplitude metric of the mixed-down signal 413. The estimate of the banded spectral amplitude metric of the mixed-down signal is in one embodiment the mixed-down banded instantaneous frequency domain amplitude metric 417 of the input audio signals, while in other embodiments, signal spectral estimation is used.

In some embodiments, the method 700 includes: a) calculating in 723 raw suppression gains including an out-of-location signal gain determined using two or more of the spatial features 419, and a noise suppression gain determined using spatially-selective noise spectral content; and b) combining the raw suppression gains to a first combined gain for each band. The noise suppression gain in some embodiments includes suppression of echoes, and its calculating 723 also uses the predicted echo spectral content 415.

In some embodiments, the method 700 further includes in 725 carrying out spatially-selective voice activity detection determined using two or more of the spatial features 419 to generate a signal classification, e.g., whether voice or not. In some embodiments, wind detection is used such that the signal classification further includes whether the signal is wind or not.

The method 700 further includes carrying out post-processing on the first combined gains of the bands to generate a post-processed gain 125 for each band. In some embodiments, the post-processing includes ensuring minimum gain, e.g., in a band dependent manner. One feature of embodiments of the present invention is that the post-processing includes carrying out percentile filtering of the combined gains, e.g., to ensure there are no outlier gains. In some embodiments, the percentile filtering is carried out in a time-frequency manner. Some embodiments of post-processing include ensuring smoothness by carrying out time and/or band-to-band smoothing.

In some embodiments, the post-processing 725 is according to the signal classification, e.g., whether voice or not, or whether wind or not, and in some embodiments, the characteristics of the percentile filtering vary according to the signal classification, e.g., whether voice or not, or whether wind or not.

In one embodiment in which echo suppression is included, the method includes calculating in 726 an additional echo suppression gain. In one embodiment, the additional echo suppression gain is included in the first combined gain which is used as a final gain for each band, and in another embodiment, the additional echo suppression gain is combined with the results of post-processing the first combined gain to generate a final gain for each band.

The method includes applying in 727 the final gain, including interpolating the gain for bin data to carry out suppression on the bin data of the mixed-down signal to form suppressed signal data 133, and applying in 729 one or both of a) output synthesis and transforming to generate output samples, and b) output remapping to generate output frequency bins.

Typically, P≥2 and Q≥1. However, the methods, systems, and apparatuses disclosed herein can scale down to remain effective for the simpler cases of P=1, Q≥1 and P≥2, Q=0. The methods and apparatuses disclosed herein even work reasonably well for P=1, Q=0. Although this final example is a reduced and perhaps trivial embodiment of the presented invention, it is noted that the ability of the proposed framework to scale is advantageous, and furthermore the lower signal operation case may be required in practice should one or more of the input audio signals or reference signals become corrupted or unavailable, e.g. due to the failure of a sensor or microphone.

Whilst the disclosure is presented for a complete noise reduction method (FIG. 7), system or apparatus (FIGS. 5, 6,) that includes all aspects of suppression, including simultaneous echo, noise, and out-of-spatial-location suppression, or presented as a computer-readable storage medium that includes instructions that when executed by one or more processors of a processing system (see FIG. 8 described below), cause a processing apparatus that includes the processing system to carry out the method such as that of FIG. 7, note that the example embodiments also provide a scalable solution for simpler applications and situations. Furthermore, noise reduction is only one example of input processing that determines gains that can be post-processed by the post-processing method that includes percentile filtering described in embodiments of the present invention.

A Processing System-Based Apparatus

Figure 8:
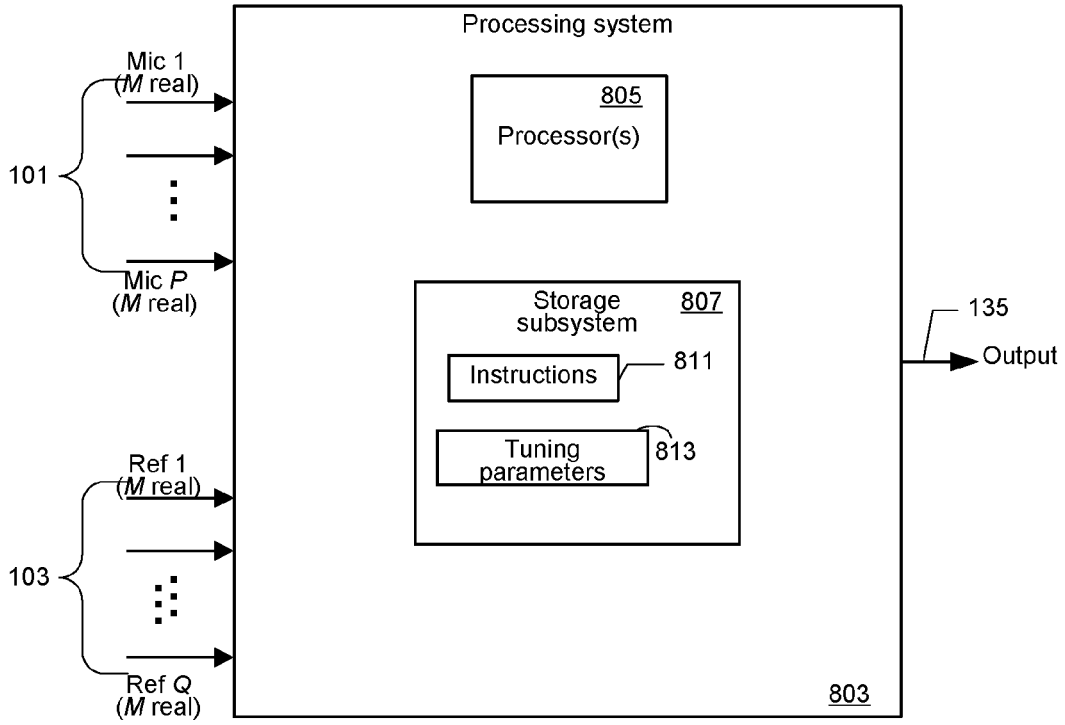
FIG. 8 shows a simplified block diagram of a processing apparatus embodiment for processing one or more audio inputs to determine a set of gains, to post-process the gains including percentile filtering the determined gains, and to generate audio output that has been modified by application of the gains.

FIG. 8 shows a simplified block diagram of one processing apparatus embodiment 800 for processing one or more of audio inputs 101, e.g., from microphones (not shown). The processing apparatus 800 is to determine a set of gains, to post-process the gains including percentile filtering the determined gains, and to generate audio output 137 that has been modified by application of the gains. One version achieves one or more of perceptual domain-based leveling, perceptual domain-based dynamic range control, and perceptual domain-based dynamic equalization that takes into account the variation in the perception of audio depending on the reproduction level of the audio signal. Another version achieved noise reduction.

One noise reduction version includes echo reduction, and in such a version, the processing apparatus also accepts one or more reference signals 103, e.g., from one or more loudspeakers (not shown) or from the feed(s) to such loudspeaker(s). In one such noise reduction version, the processing apparatus 800 is to generate audio output 137 that has been modified by suppressing, in one embodiment noise and out-of-location signals, and in another embodiment also echoes as specified in accordance to one or more features of the present invention. The apparatus, for example, can implement the system shown in FIG. 6, and any alternates thereof, and can carry out, when operating, the method of FIG. 7 including any variations of the method described herein. Such an apparatus may be included, for example, in a headphone set such as a Bluetooth headset. The audio inputs 101, the reference input(s) 103 and the audio output 137 are assumed to be in the form of frames of M samples of sampled data. In the case of analog input, a digitizer including an analog-to-digital converter and quantizer would be present. For audio playback, a de-quantizer and a digital-to-analog converter would be present. Such and other elements that might be included in a complete audio processing system, e.g., a headset device are left out, and how to include such elements would be clear to one skilled in the art.

The embodiment shown in FIG. 8 includes a processing system 803 that is configured in operation to carry out the suppression methods described herein. The processing system 803 includes at least one processor 805, which can be the processing unit(s) of a digital signal processing device, or a CPU of a more general purpose processing device. The processing system 803 also includes a storage subsystem 807 typically including one or more memory elements. The elements of the processing system are coupled, e.g., by a bus subsystem or some other interconnection mechanism not shown in FIG. 8. Some of the elements of processing system 803 may be integrated into a single circuit, using techniques commonly known to one skilled in the art.

The storage subsystem 807 includes instructions 811 that when executed by the processor(s) 805, cause carrying out of the methods described herein.

In some embodiments, the storage subsystem 807 is configured to store one or more tuning parameters 813 that can be used to vary some of the processing steps carried out by the processing system 803.

The system shown in FIG. 8 can be incorporated in a specialized device such as a headset, e.g., a wireless Bluetooth headset. The system also can be part of a general purpose computer, e.g., a personal computer configured to process audio signals.

Voice Activity Detection with Settable Sensitivity

In some embodiments of the invention, the post-processing, e.g., the percentile filtering is controlled by signal classification as determined by a VAD. The invention is not limited to any particular type of VAD, and many VADs are known in the art. When applied to suppression, the inventors have discovered that suppression works best when different parts of the suppression system are controlled by different VADs, each such VAD custom designed for the functions of the suppressor in which it is used in, rather than having an "optimal" VAD for all uses. Therefore, in some versions of the input processing for noise reduction, a plurality of VADs, each controlled by a small set of tuning parameters that separately control sensitivity and selectivity, including spatial selectivity, such parameters tuned according to the suppression elements in which the VAD is used. Each of the plurality of the VADs is an instantiation of a universal VAD that determines indications of voice activity from $Y'_b$. The universal VAD is controlled by a set of parameters and uses an estimate of noise spectral content, the banded frequency domain amplitude metric representation of the echo, and the banded spatial features. The set of parameters includes whether the estimate of noise spectral content is spatially selective or not. The type of indication of voice activity that a particular instantiation determines is controlled by a selection of the parameters.

One embodiment of a general spatially-selective VAD structure—the universal VAD to calculate voice activity that can be tuned for various functions—is $$S = \sum_{b=1}^{B} (BeamGain'_b)^{BeamGainExp}\left(\frac{\max(0,\ Y'_b - \beta_{b_N}\cdot(N'_b \vee N'_{b,S}) - \beta_{b_E}E'_b)}{Y'_b + Y'_{b_{sens}}}\right),$$

where $BeamGain'_b = BeamGain_{min} + (1 - BeamGain_{min})\, RPI'_b \cdot PPI'_b \cdot CPI'_b$, BeamGainExp is a parameter that for larger values increases the aggressiveness of the spatial selectivity of the VAD, and is 0 for a non-spatially-selective VAD, $N'_b N'_{b,S}$ denotes either the total noise power (or other frequency domain amplitude metric) estimate $N'_b$, or the spatially-selective noise estimate $N'_{b,S}$ determined using the out-of-beam power (or other frequency domain amplitude metric), $\beta_N$, $\beta_E > 1$ are margins for noise end echo, respectively and $Y'_{sens}$ is a settable sensitivity offset. The values of $\beta_N$, $\beta_E$ are between 1 and 4. BeamGainExp is between 0.5 to 2.0 when spatial selectivity is desired, and is 1.5 for one embodiment of a spatially-selective VAD, e.g., used to control post-processing in some embodiments of the invention. $RPI'_b$, $PPI'_b$, and $CPI'_b$ are, as above, three spatial probability indicators, namely the ratio probability indicator, the phase probability indicator, and the coherence probability indicator.

The above expression also controls the operation of the universal voice activity detecting method.

For any given set of parameters to generate the voice indicator value S a binary decision or classifier can be obtained by considering the test $S > S_{thresh}$ as indicating the presence of voice. It should also be apparent that the value S can be used as a continuous indicator of the instantaneous voice level. Furthermore, an improved useful universal VAD for operations such as transmission control or controlling the post processing could be obtained using a suitable "hang over" or period of continued indication of voice after a detected event. Such a hang over period may vary from 0 to 500 ms, and in one embodiment a value of 200 ms was used. During the hang over period, it can be useful to reduce the activation threshold, for example by a factor of ⅔. This creates increased sensitivity to voice and stability once a talk burst has commenced.

For spatially-selective voice activity detection to control one or more post-processing operations, e.g., for a spatially-selective VAD, the noise in the above expression is $N'_{b,S}$ determined using an out-of-beam estimate of power (or other frequency domain amplitude metric). $Y_{sens}$ is set to be around expected microphone and system noise level, obtained by experiments on typical components.

Examples of Percentile Filtering Results

Figure 9:
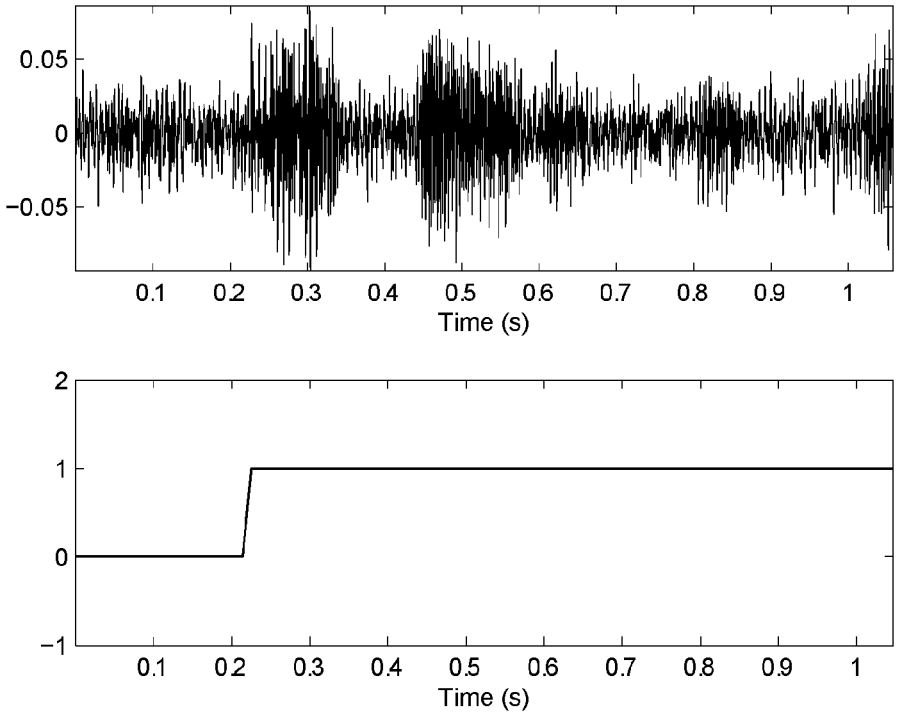
FIG. 9 shows an example input waveform and a corresponding voice activity detector output for noisy speech in a mixture of clean speech and car noise.

FIG. 9 shows an input waveform and the corresponding VAD value for a VAD, where 0 indicates unvoiced and 1 indicates voiced speech. The noisy speech is a mixture of clean speech and car noise at 0 dB signal-to-noise ratio (SNR).

Figure 10:
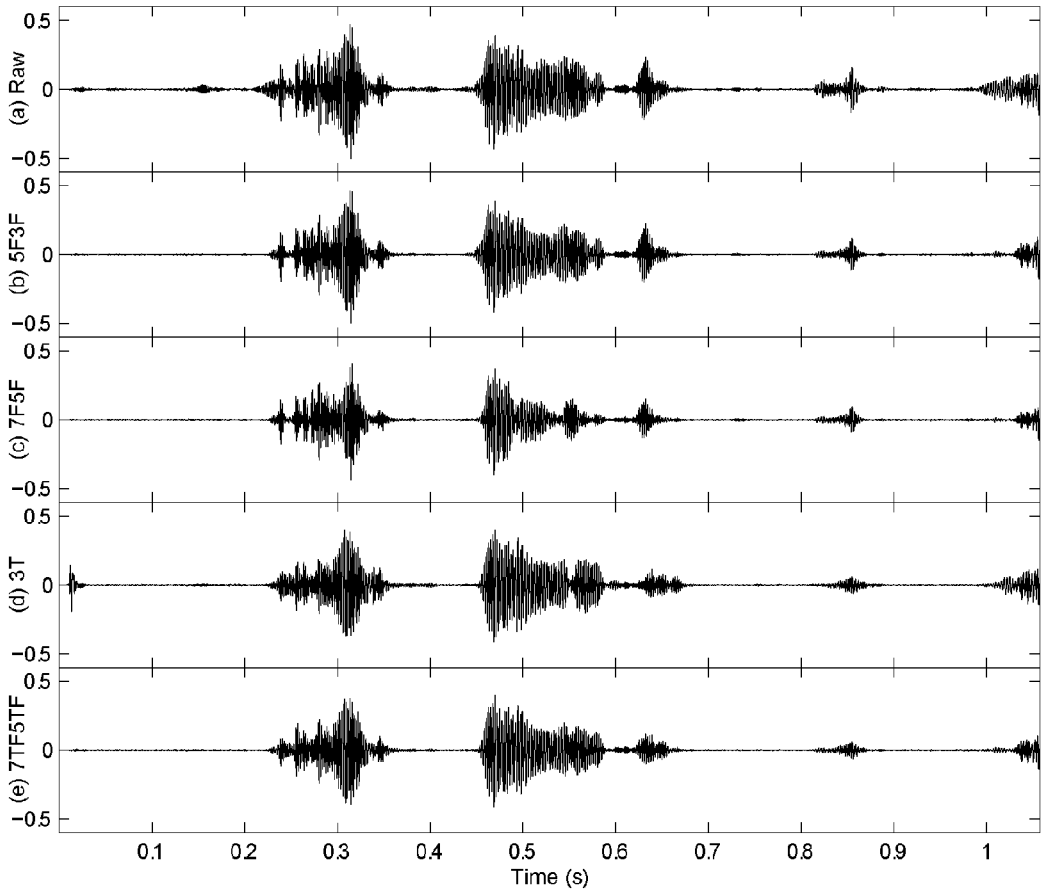
FIG. 10 shows five plots denoted (a) though (e) that show the processed waveform for the signal of FIG. 9 using different median filtering strategies including an embodiment of the present invention.

FIG. 10 shows five plots denoted (a) though (e) that show the processed waveform using different median filtering strategies including an embodiment of the present invention. The result (a) in FIG. 10 is the result of using the raw gains without any post-processing. The result (b) in FIG. 10 is the result of using a 5-point frequency-only median filter for unvoiced and a 3-point frequency-only median filter for voiced. The result (c) in FIG. 10 is the result of using a 7-point frequency-only median filter for unvoiced and a 5-point frequency-only median filter for voiced. The result (d) in FIG. 10 is the result of only using a 3-point time-only median filter. The result (e) in FIG. 10 is the result of using a 7-point time-frequency median filter for unvoiced and a 5-point time-frequency median filter for voiced. It is evident that results (e) of FIG. 10 using an embodiment of the percentile filtering method of the present invention a demonstrate much smoother temporal envelope compared with the frequency-only approach as well as time-only median filtering. Perceptual listening also confirms the proposed filter generates more pleasant output containing fewer artifacts. However, the inventors noted that sometimes there was slightly more distortion at the voice onset than using the raw non-post-processed gains, but the attenuation is barely noticeable in most cases including the example shown in the FIG. 10. In an improved embodiment, the VAD was tuned to be more sensitive, e.g., using spatially-selective parameters, and temporal percentile filtering was eliminated (that is, the percentile filter was changed to a frequency-band only filter when a voice onset is detected.

Figure 11:
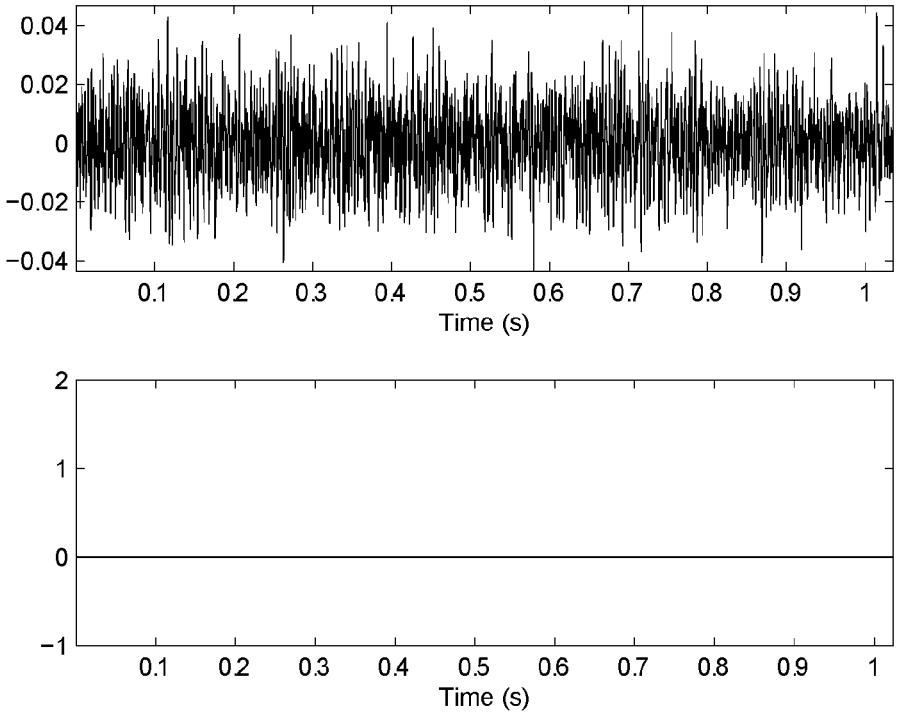
FIG. 11 shows an example input waveform of a segment of car noise and a corresponding voice activity detector output.
Figure 12:
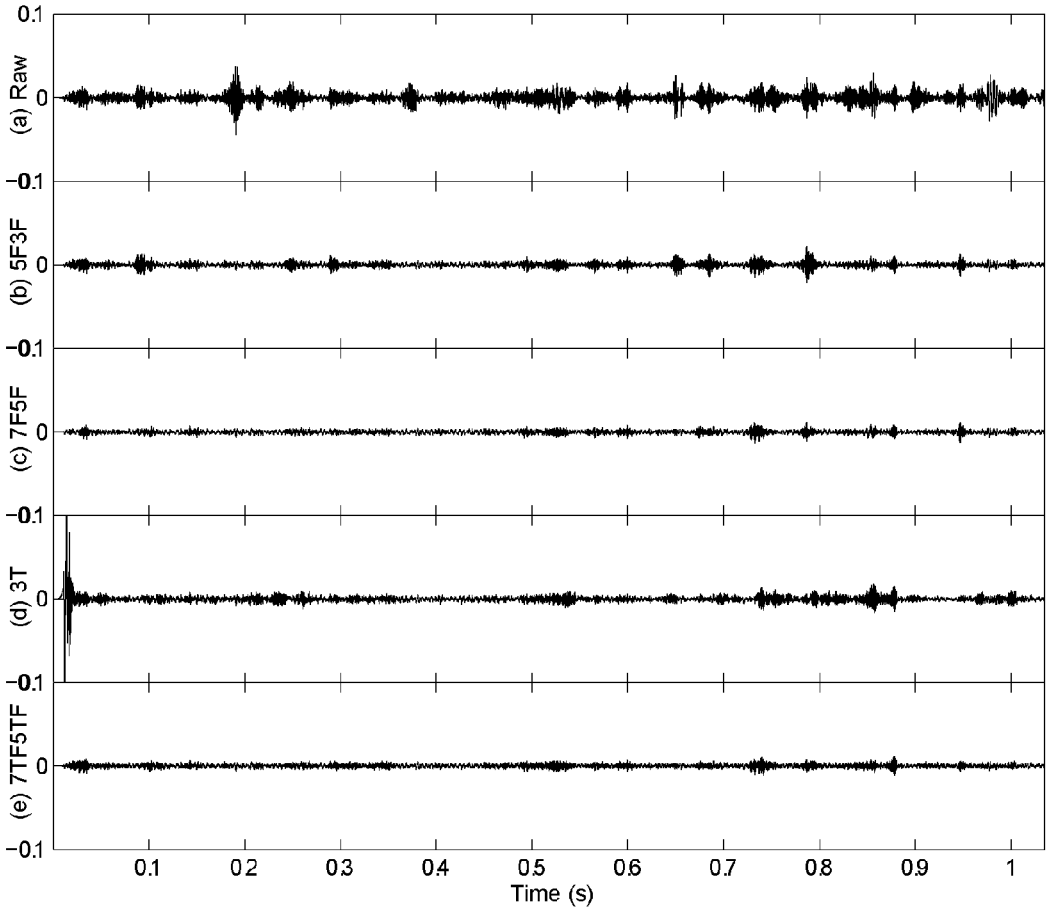
FIG. 12 shows five plots denoted (a) though (e) that show the processed waveform for the signal of FIG. 11 using different median filtering strategies including an embodiment of the present invention.

The examples of FIGS. 9 and 10 demonstrate the advantages of a time-frequency median filter for voice signals. To further illustrate its impact on noise, a segment of car noise was processed. FIG. 11 shows the input waveform of a segment of car noise and the corresponding VAD value. FIG. 12 shows processed outputs, denoted (a) through (e) using different median filtering methods, including an embodiment of the present invention, for the segment of car noise of FIG. 11. The vertical axis in FIG. 11 has been scaled to [−0.1, 0.1] for illustration purpose. The result (a) in FIG. 12 is the result of using the raw gains without any post-processing. The result (b) in FIG. 12 is the result of using a 5-point frequency-only median filter for unvoiced (and a 3-point frequency-only median filter for voiced, which does not occur here). The result (c) in FIG. 12 is the result of using a 7-point frequency-only median filter for unvoiced and a 5-point frequency-only median filter for voiced (voiced is not present here). The result (d) in FIG. 12 is the result of only using a 3-point time-only median filter. The result (e) in FIG. 12 is the result of using a 7-point time-frequency median filter for unvoiced and a 5-point time-frequency median filter for voiced (there is no voiced here). It is evident that results (e) of FIG. 12 using an embodiment of the percentile filtering method of the present invention demonstrate a much smoother results with a lower noise floor.

General

It is appreciated that throughout the specification discussions using terms such as "processing," "computing," "calculating," "determining" or the like, may refer to, without limitation, the action and/or processes of circuitry, or of a computer or computing system, or similar electronic computing device, or other hardware that manipulates and/or transforms data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

Note that when a method is described that includes several elements, e.g., several steps, no ordering of such elements, e.g., of such steps is implied, unless specifically stated.

The methodologies described herein are, in some embodiments, performable by one or more processors that accept logic: instructions encoded on one or more computer-readable media. When executed by one or more of the processors, the instructions cause carrying out at least one of the methods described herein. Any processor capable of executing a set of instructions (sequential or otherwise) that specify actions to be taken is included. Thus, one example is a typical processing system that includes one or more processors. Each processor may include one or more of a CPU or similar element, a graphics processing unit (GPU), field-programmable gate array, application-specific integrated circuit, and/or a programmable DSP unit. The processing system further includes a storage subsystem with at least one storage medium, which may include memory embedded in a semiconductor device, or a separate memory subsystem including main RAM and/or a static RAM, and/or ROM, and also cache memory. The storage subsystem may further include one or more other storage devices, such as magnetic and/or optical and/or further solid state storage devices. A bus subsystem may be included for communicating between the components. The processing system further may be a distributed processing system with processors coupled by a network, e.g., via network interface devices or wireless network interface devices. If the processing system requires a display, such a display may be included, e.g., a liquid crystal display (LCD), organic light emitting display (OLED), or a cathode ray tube (CRT) display. If manual data entry is required, the processing system also includes an input device such as one or more of an alphanumeric input unit such as a keyboard, a pointing control device such as a mouse, and so forth. Each of the terms storage device, storage subsystem, and memory unit as used herein, if clear from the context and unless explicitly stated otherwise, also encompasses a storage system such as a disk drive unit. The processing system in some configurations may include a sound output device, and a network interface device.

In some embodiments, a non-transitory computer-readable medium is configured with, e.g., encoded with instructions, e.g., logic that when executed by one or more processors of a processing system such as a digital signal processing device or subsystem that includes at least one processor element and a storage subsystem, cause carrying out a method as described herein. Some embodiments are in the form of the logic itself. A non-transitory computer-readable medium is any computer-readable medium that is not specifically a transitory propagated signal or a transitory carrier wave or some other transitory transmission medium. The term "non-transitory computer-readable medium" thus covers any tangible computer-readable storage medium. Non-transitory computer-readable media include any tangible computer-readable storage media and may take many forms including non-volatile storage media and volatile storage media. Non-volatile storage media include, for example, static RAM, optical disks, magnetic disks, and magneto-optical disks. Volatile storage media includes dynamic memory, such as main memory in a processing system, and hardware registers in a processing system. In a typical processing system as described above, the storage subsystem thus a computer-readable storage medium that is configured with, e.g., encoded with instructions, e.g., logic, e.g., software that when executed by one or more processors, causes carrying out one or more of the method steps described herein. The software may reside in the hard disk, or may also reside, completely or at least partially, within the memory, e.g., RAM and/or within the processor registers during execution thereof by the computer system. Thus, the memory and the processor registers also constitute a non-transitory computer-readable medium on which can be encoded instructions to cause, when executed, carrying out method steps.

While the computer-readable medium is shown in an example embodiment to be a single medium, the term "medium" should be taken to include a single medium or multiple media (e.g., several memories, a centralized or distributed database, and/or associated caches and servers) that store the one or more sets of instructions.

Furthermore, a non-transitory computer-readable medium, e.g., a computer-readable storage medium may form a computer program product, or be included in a computer program product.

In alternative embodiments, the one or more processors operate as a standalone device or may be connected, e.g., networked to other processor(s), in a networked deployment, or the one or more processors may operate in the capacity of a server or a client machine in server-client network environment, or as a peer machine in a peer-to-peer or distributed network environment. The term processing system encompasses all such possibilities, unless explicitly excluded herein. The one or more processors may form a personal computer (PC), a media playback device, a headset device, a hands-free communication device, a tablet PC, a set-top box (STB), a personal digital assistant (PDA), a game machine, a cellular telephone, a Web appliance, a network router, switch or bridge, or any machine capable of executing a set of instructions (sequential or otherwise) that specify actions to be taken by that machine.

Note that while some diagram(s) only show(s) a single processor and a single storage subsystem, e.g., a single memory that stores the logic including instructions, those skilled in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, as will be appreciated by those skilled in the art, embodiments of the present invention may be embodied as a method, an apparatus such as a special purpose apparatus, an apparatus such as a data processing system, logic, e.g., embodied in a non-transitory computer-readable medium, or a computer-readable medium that is encoded with instructions, e.g., a computer-readable storage medium configured as a computer program product. The computer-readable medium is configured with a set of instructions that when executed by one or more processors cause carrying out method steps. Accordingly, aspects of the present invention may take the form of a method, an entirely hardware embodiment, an entirely software embodiment or an embodiment combining software and hardware aspects. Furthermore, the present invention may take the form of program logic, e.g., a computer program on a computer-readable storage medium, or the computer-readable storage medium configured with computer-readable program code, e.g., a computer program product.

It will also be understood that embodiments of the present invention are not limited to any particular implementation or programming technique and that the invention may be implemented using any appropriate techniques for implementing the functionality described herein. Furthermore, embodiments are not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the DESCRIPTION OF EXAMPLE EMBODIMENTS are hereby expressly incorporated into this DESCRIPTION OF EXAMPLE EMBODIMENTS, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

While in one embodiment, the short time Fourier transform (STFT) is used to obtain the frequency bands, the invention is not limited to the STFT. Transforms such as the STFT are often referred to as circulant transforms. Most general forms of circulant transforms can be represented by buffering, a window, a twist (real value to complex value transformation) and a DFT, e.g., FFT. A complex twist after the DFT can be used to adjust the frequency domain representation to match specific transform definitions. The invention may be implemented by any of this class of transforms, including the modified DFT (MDFT), the short time Fourier transform (STFT), and with a longer window and wrapping, a conjugate quadrature mirror filter (CQMF). Other standard transforms such as the Modified discrete cosine transform (MDCT) and modified discrete sine transform (MDST), can also be used, with an additional complex twist of the frequency domain bins, which does not change the underlying frequency resolution or processing ability of the transform and thus can be left until the end of the processing chain, and applied in the remapping if required.

All U.S. patents, U.S. patent applications, and International (PCT) patent applications designating the United States cited herein are hereby incorporated by reference. In the case the Patent Rules or Statutes do not permit incorporation by reference of material that itself incorporates information by reference, the incorporation by reference of the material herein excludes any information incorporated by reference in such incorporated by reference material, unless such information is explicitly incorporated herein by reference.

Any discussion of other art in this specification should in no way be considered an admission that such art is widely known, is publicly known, or forms part of the general knowledge in the field at the time of invention.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting of only elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added to or deleted from methods described within the scope of the present invention.

We claim:

1. A method of post-processing banded gains to generate post-processed gains for applying to an audio signal, the banded gains determined by input processing one or more input audio signals, the method comprising:

generating a particular post-processed gain for a particular frequency band of a current frame of the one or more input audio signals, including at least percentile filtering using gain values from one or more previous frames of the one or more input audio signals in a time domain and from gain values for at least one frequency band adjacent to the particular frequency band for the current frame in a frequency domain, wherein the at least one frequency band comprises one or more frequency bins, wherein the gain values from the one or more previous frames use the gain values for the particular frequency band, and wherein the gain values from the one or more previous frames exclude the at least one frequency band adjacent to the particular frequency band for the one or more previous frames.

2. A method as recited in claim 1, further comprising, after the percentile filtering, at least one of frequency-band-to-frequency-band smoothing and smoothing across time.

3. A method as recited in claim 1, wherein one or both of a width and a depth of the percentile filtering depends on signal classification or spectral flux of the one or more input audio signals.

4. A method as recited in claim 3, wherein the classification includes whether the input audio signals are likely or not to be voice.

5. A method as recited in claim 1, wherein one or both of a width and a depth of the percentile filtering for the particular frequency band depends on the particular frequency band.

6. A method as recited in claim 1, wherein the percentile filtering is of a percentile value, and wherein the percentile value is the median.

7. A method as recited in claim 1, wherein the percentile filtering is of a percentile value, and wherein the percentile value depends on one or more of on classification of the one or more input audio signals and the spectral flux of the one or more input audio signals.

8. A method as recited in claim 1, wherein the percentile filtering is weighted percentile filtering.

9. A method as recited in claim 1, wherein the banded gains determined from one or more input audio signals are for one or more of reducing noise or out-of-location signals or echoes.

10. A method as recited in claim 1, wherein the banded gains are for one or more of perceptual domain-based leveling, perceptual domain-based dynamic range control, and perceptual domain-based dynamic equalization.

11. A tangible non-transitory computer-readable storage medium comprising instructions that when executed by one or more processors of a processing system cause processing hardware to carry out a method of post-processing banded gains for applying to an audio signal, the method as recited in claim 1.

12. An apparatus to post-process banded gains for applying to an audio signal, the banded gains determined by input processing one or more input audio signals, the apparatus comprising:

a post-processor accepting the banded gains to generate post-processed gains, generating a particular post-processed gain for a particular frequency band of a current frame of the one or more input audio signals, including percentile filtering using gain values from one or more previous frames of the one or more input audio signals in a time domain and from gain values for at least one frequency band adjacent to the particular frequency band for the current frame in a frequency domain, wherein the at least one frequency band comprises one or more frequency bins, wherein the gain values from the one or more previous frames use the gain values for the particular frequency band, and wherein the gain values from the one or more previous frames exclude the at least one frequency band adjacent to the particular frequency band for the one or more previous frames.

13. An apparatus as recited in claim 12, wherein the post-processor includes a smoothing filter to smooth the percentile filtered gains, including at least one of frequency-band-to-frequency-band smoothing and smoothing across time.

14. An apparatus as recited in claim 12, further comprising a signal classifier to generate a signal classification of the one or more input audio signals, wherein one or both of a width and a depth of the percentile filtering depends on the signal classification or spectral flux of the one or more input audio signals.

15. An apparatus as recited in claim 14, wherein the signal classifier includes a voice activity detector such that the signal classification includes whether the input audio signals are likely or not to be voice.

16. An apparatus as recited in claim 12, wherein one or both of a width and a depth of the percentile filtering for the particular frequency band depends on the particular frequency band.

17. An apparatus as recited in claim 12, wherein the percentile filtering is of a percentile value, and wherein the percentile value depends on one or more of a classification of the one or more input audio signals and the spectral flux of the one or more input audio signals.

18. An apparatus as recited in claim 12, wherein the percentile filtering is weighted percentile filtering.

19. An apparatus as recited in claim 12, wherein the banded gains determined from one or more input audio signals are for one or more of reducing noise or out-of-location signals or echoes.

20. An apparatus as recited in claim 12, wherein the banded gains are for one or more of perceptual domain-based leveling, perceptual domain-based dynamic range control, and perceptual domain-based dynamic equalization.

* * * * *